US012663232B1

(12) United States Patent
Gensler

(10) Patent No.: US 12,663,232 B1
(45) Date of Patent: Jun. 23, 2026

(54) SMART PISTON

(71) Applicant: BAE Systems Information and Electronic Systems Integration Inc., Nashua, NH (US)

(72) Inventor: Jeffrey A. Gensler, Austin, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 312 days.

(21) Appl. No.: 18/364,516

(22) Filed: Aug. 3, 2023

(51) Int. Cl.
*F41A 19/68* (2006.01)
*F41A 31/00* (2006.01)
*F42B 12/70* (2006.01)

(52) U.S. Cl.
CPC ..... *F41A 19/68* (2013.01); *F41A 31/00* (2013.01); *F42B 12/70* (2013.01)

(58) Field of Classification Search
CPC ..... F41A 19/65; F41A 19/68; F42B 12/70
See application file for complete search history.

(56) References Cited

U.S. PATENT DOCUMENTS 3,712,224 A * 1/1973 Hanzel ..... F21L 17/00 42/105
4,135,455 A * 1/1979 Wallace ..... F42B 5/035 102/505
4,313,379 A * 2/1982 Wallace ..... F41A 19/65 102/217
4,374,494 A * 2/1983 Maury ..... F42B 12/70 102/357
4,404,912 A * 9/1983 Sindermann ..... F42B 12/70 102/505
4,586,439 A * 5/1986 Wrana ..... F42B 12/62 102/438
4,621,579 A * 11/1986 Badura ..... F42B 5/15 102/357
5,411,225 A * 5/1995 Lannon ..... F42B 5/15 102/505
5,461,960 A * 10/1995 Marks ..... H01R 31/06 89/1.51
5,801,321 A * 9/1998 LaGrange ..... F42B 4/26 102/340
6,983,385 B2 1/2006 German et al.
(Continued)

FOREIGN PATENT DOCUMENTS

CA 2617770 A1 * 1/2007 ..... F42B 12/365
EP 0461439 A1 * 12/1991 ..... F41A 19/68
(Continued)

*Primary Examiner* — Gabriel J. Klein
(74) *Attorney, Agent, or Firm* — Sand, Sebolt & Wernow LPA

(57) ABSTRACT

A smart piston for a countermeasure expendable. The smart piston may include a main body, a gasket that operably engages with the main body, and an electronic system that is carried by the main body. Upon assembly, the electronic system of the smart piston is positioned between the main body and the gasket. The electronic system of the smart piston is configured to provide electrical communication to a payload of countermeasure expendable by passing the electrical communication through the main body to the payload of the countermeasure expendable where the electronic system and the payload are spaced apart from one another.

12 Claims, 20 Drawing Sheets

(56) References Cited

U.S. PATENT DOCUMENTS

| | | | | |
|---|---|---|---|---|
| 7,091,693 | B2 | 8/2006 | Grunert et al. | |
| 7,158,843 | B2 | 1/2007 | Smith | |
| 7,278,658 | B2 | 10/2007 | Boucher et al. | |
| 7,299,427 | B2 | 11/2007 | Settles | |
| 7,343,859 | B2 | 3/2008 | Matsuda et al. | |
| 7,421,950 | B2 * | 9/2008 | Dillard | F41J 2/02 102/504 |
| 7,640,858 | B1 * | 1/2010 | Herbage | C06B 21/0041 102/336 |
| 7,878,120 | B1 * | 2/2011 | Nodarse | F42B 5/285 102/470 |
| 8,154,255 | B2 | 4/2012 | Wang et al. | |
| 9,003,944 | B2 | 4/2015 | Zätterqvist | |
| 9,689,928 | B2 | 6/2017 | Bernardon | |
| 9,811,079 | B2 | 11/2017 | Theiss | |
| 9,870,333 | B1 | 1/2018 | Lam et al. | |
| 9,995,793 | B2 | 6/2018 | Bernardon | |
| 10,140,238 | B2 | 11/2018 | Mundt et al. | |
| 10,211,488 | B2 | 2/2019 | Willgert et al. | |
| 10,409,756 | B2 | 9/2019 | Zhao et al. | |
| 10,611,330 | B2 | 4/2020 | Phillion et al. | |
| 10,697,742 | B2 | 6/2020 | Dube et al. | |
| 12,235,061 | B1 * | 2/2025 | Kohl | F42B 5/15 |
| 12,253,342 | B1 * | 3/2025 | Gensler | F42B 5/02 |
| 2004/0064744 | A1 | 4/2004 | German et al. | |
| 2013/0167711 | A1 * | 7/2013 | Zatterqvist | F42B 12/70 89/1.56 |
| 2014/0138474 | A1 * | 5/2014 | Sharpin | G06T 7/246 244/3.22 |
| 2014/0242420 | A1 | 8/2014 | Schaffner et al. | |
| 2015/0354920 | A1 * | 12/2015 | Edge | F41F 1/08 89/1.41 |
| 2016/0047628 | A1 * | 2/2016 | Kolanek | F41G 7/007 701/4 |
| 2016/0048129 | A1 * | 2/2016 | Kolanek | G05D 1/0022 701/2 |
| 2017/0074626 | A1 * | 3/2017 | Secco | F42B 5/15 |
| 2017/0327068 | A1 | 11/2017 | Phillion et al. | |
| 2019/0178613 | A1 * | 6/2019 | Zaetterqvist | B64D 7/00 |
| 2019/0234718 | A1 * | 8/2019 | Dube | F42B 5/15 |
| 2020/0003529 | A1 * | 1/2020 | Benezra | B64U 80/70 |
| 2021/0404783 | A1 | 12/2021 | Branch et al. | |
| 2022/0397360 | A1 | 12/2022 | Plemons et al. | |

FOREIGN PATENT DOCUMENTS

| | | | | |
|---|---|---|---|---|
| FR | 2492087 | A1 * | 4/1982 | F42B 12/70 |
| FR | 2867556 | A1 * | 9/2005 | F41J 2/02 |
| GB | 2138546 | A * | 10/1984 | F42B 5/15 |
| GB | 2470626 | A * | 12/2010 | F42B 12/70 |
| GB | 2480354 | | 11/2011 | |
| GB | 2480355 | A * | 11/2011 | F42B 12/70 |
| GB | 2504632 | | 2/2014 | |
| GB | 2520810 | | 6/2015 | |
| WO | WO-2006122984 | A1 * | 11/2006 | F42B 3/117 |
| WO | 2011010163 | | 1/2011 | |
| WO | 2011101692 | | 8/2011 | |
| WO | 2021262984 | | 12/2021 | |
| WO | 2023014569 | | 2/2023 | |

* cited by examiner

SMART PISTON

STATEMENT OF GOVERNMENT INTEREST

This invention was made with government support under Prime Contract No. 14 D 0423/21 F 0005 awarded by a classified federal agency. The government has certain rights in the invention.

RELATED APPLICATIONS

Initially, it is noted that the present disclosure is related to the below listed U.S. Patent applications ("the Incorporated Applications"), filed on equal date herewith, the entirety of each of which is incorporated herein as if fully rewritten. The Incorporated Applications are:

1. U.S. patent application Ser. No. 18/364,508, entitled "IMPULSE CARTRIDGE CUP FOR SMART STORES COMMUNICATION INTERFACE SQUIB WITH ELECTRONICS";
2. U.S. patent application Ser. No. 18/364,514, entitled "COUNTERMEASURE EXPENDABLE HAVING A REMOVABLE PORT PLUG AND COUNTERMEASURE DISPENSER SYSTEM IMPLEMENTING THE SAME";
3. U.S. patent application Ser. No. 18/364,522, entitled "SQUIB ENABLED HOLD UP BATTERY SWITCH";
4. U.S. patent application Ser. No. 18/364,527, entitled "MODULAR COMMON CONTROL CARD"; and
5. U.S. patent application Ser. No. 18/364,528, entitled "SMART STORE COMMUNICATION INTERFACE (SSCI) COMPATIBLE SQUIB DESIGN".

Since the present disclosure is related to the Incorporated Applications, some similar structural nomenclature is used herein when referencing some portions of the present disclosure relative to the Incorporated Applications. However, there may be some instances where structural nomenclature differs between similar elements and there may be other instances where nomenclature is similar between distinct elements relative to the present disclosure and the Incorporated Applications.

TECHNICAL FIELD

The present disclosure relates to smart technology provided inside of a countermeasure expendable for a countermeasure dispensing system (CMDS), particularly a smart piston of a countermeasure expendable.

BACKGROUND ART

In current military technologies, military platforms, such as a military aircraft, include at least one countermeasure dispensing system (CMDS). The CMDS may eject one or more countermeasure expendables from the platform to dispense chaff material or flares away from the platform to counter a detected incoming threat, such as missiles or similar ballistic threats. Such dispensing of chaff material or flares away from the platform may then redirect the incoming threat away from the platform to leave the platform unscathed and/or unharmed. Each countermeasure dispenser in a CMDS is also electrically connected to a sequencer unit for ejecting the countermeasure expendables from the military platform. However, upon dispensing, these countermeasure expendables must dispense at suitable distances away from the military platform to ensure the incoming threat does not damage or destroy the military platform upon detonation of the incoming threat.

To combat these issues, conventional countermeasure expendables may include various technologies to ensure the countermeasure materials are dispensed at suitable distances away from the military platform to ensure the incoming threat does not damage or destroy the military platform upon detonation of the incoming threat. However, such countermeasure expendables use archaic and/or mechanical time delay devices (i.e., fuses and other similar time delays of the like) to ensure the countermeasure materials are dispensed at suitable distances away from the military platform. With such technology, testing and/or updating these countermeasure expendables may require extensive field testing that results in extensive labor and experimental costs.

SUMMARY OF THE INVENTION

In one aspect, an exemplary embodiment of the present disclosure may provide a smart piston for a countermeasure expendable. The smart piston includes a main body, a gasket operably engaged with the main body, and an electronic system carried by the main body. The electronic system is in electrical communication with the payload of the countermeasure expendable and is positioned between the main body and the gasket.

This exemplary embodiment or another exemplary embodiment may further include that the electronic system enables at least one electrical signal to pass through the main body to the payload of the countermeasure expendable where the electronic system and the payload are spaced apart from one another. This exemplary embodiment or another exemplary embodiment may further include that the electronic system comprises: an electronic circuit board carried; at least one electrical port operably engaged with the electronic circuit board and having a first amperage rating for sending at least one communication signal; and a set of connecting pins operably engaged with the electronic circuit board and the at least one electrical port; wherein the electronic circuit board, the at least one electrical port, and the set of connecting pins are in electrical communication with one another. This exemplary embodiment or another exemplary embodiment may further include that that each connecting pin of the set of connecting pins passes entirely through the main body. This exemplary embodiment or another exemplary embodiment may further include that the at least one electrical port is adapted to electrically connect an impulse cartridge cup of the countermeasure expendable and the on-board processing unit of the countermeasure expendable with one another. This exemplary embodiment or another exemplary embodiment may further include that the electronic system further comprises: at least another electrical port operably engaged with the electronic circuit board and the set of connecting pins and having a second amperage rating that is greater than the first amperage rating of the at least one electrical port for sending at least one power signal; wherein the electronic circuit board, the at least one electrical port, the at least another electrical port, and the set of connecting pins are in electrical communication with one another. This exemplary embodiment or another exemplary embodiment may further include that the at least one electrical port is adapted to electrically connect an external testing unit with the on-board processing unit of the countermeasure expendable for powering the on-board processing unit with the external testing unit and for communicating with the on-board processing unit with the external testing unit; and wherein the at least one electrical port is adapted to electrically connect an external testing unit with at least one powered electronic of the payload for powering the at least one high-power electronic with the external testing unit. This exemplary embodiment or another exemplary embodiment further includes that the main body comprises: a front end; a rear end opposite to the front end; and a set of through-holes defined in the main body extending between the front end and the rear end; wherein the set of connecting pins is housed inside of the set of through-holes and extends from the front end of the main body to the rear end of the main body; wherein the at least one electrical port operably engages at the rear end of the main body. This exemplary embodiment or another exemplary embodiment further includes that the main body further comprises: a set of extensions extending outwardly from a base wall of the main body towards the front end of the main body; wherein the set of extensions and the set of connecting pins operably engage with one another; and wherein one extension of the set of extensions defines a diameter that is greater than diameters of remaining extensions of the set of extensions for aligning the smart piston with the payload of the countermeasure expandable. This exemplary embodiment or another exemplary embodiment further includes that the gasket comprises: a base wall of the gasket operably engaging with the main body; and an upright wall of the gasket extending outwardly from a peripheral edge of the base wall and being free from engaging with the main body; wherein the upright wall is adapted to provide a tight seal between the smart piston and a canister of the countermeasure expendable. This exemplary embodiment or another exemplary embodiment further includes that the gasket is made of a resilient material. This exemplary embodiment or another exemplary embodiment further includes a protrusion of the main body extending outwardly from the rear end of the main body; a hollow protrusion of the gasket extending outwardly from the base wall of the gasket; and at least one attachment aperture defined in the electronic circuit board for receiving the protrusion of the main body and the hollow protrusion of the gasket; wherein the protrusion of the main body operably engages with the gasket inside of the hollow protrusion. This exemplary embodiment or another exemplary embodiment further includes a hollow projection of the main body extending outwardly from the rear end of the main body; a tubular extension of the gasket extending outwardly from the base wall of the gasket; and a central opening defined in the electronic circuit board for receiving the hollow projection and the tubular extension; wherein the hollow projection of the main body operably engages with the gasket inside of the tubular extension. This exemplary embodiment or another exemplary embodiment further includes a biaser operably engaged with the main body inside of the hollow projection; wherein the biaser is adapted to bias the smart piston and a payload of the countermeasure expendable away from one another external of the canister of the countermeasure expendable. This exemplary embodiment or another exemplary embodiment further includes that the main body further comprises: a set of extension arms; a base wall positioned between the front end and the rear end; and a recess extending inwardly from the front end of the main body to the base wall of the main body; wherein a portion of the payload of the countermeasure expendable is housed inside of the recess and operably engages with the set of extension arms and the interior wall.

In another aspect, an exemplary embodiment of the present disclosure may provide a method. The method comprises steps of effecting at least one electrical signal to be sent from an impulse cartridge cup of a countermeasure expendable to at least one electrical port of an electronic system of a smart piston of the countermeasure expendable; effecting the at least one electrical signal to be sent from the at least one electrical port to an electrical circuit board of the electronic system of the smart piston; effecting the at least one electrical signal to be sent from the electrical circuit board to a set of connecting pins of the smart piston; and effecting the at least one electrical signal to be sent from the set of connecting pins to a payload of the countermeasure expendable, wherein the at least one electrical signal passes through the smart piston.

This exemplary embodiment or another exemplary embodiment further includes that the step of effecting the at least one electrical signal to be sent from the impulse cartridge cup to the at least one electrical port further includes effecting the at least one electrical signal to be sent from the impulse cartridge cup to the at least one electrical port by a set of first electrical connections. This exemplary embodiment or another exemplary embodiment further includes that the steps of effecting the at least one electrical signal to be sent from the electrical circuit board to the set of connecting pins and effecting the at least one electrical signal to be sent from the set of connecting pins to the payload further comprising: effecting the at least one electrical signal to be sent from the electrical circuit board to a set of input terminals of the set of connecting pins, wherein the set of input terminals are positioned proximate to a rear end of the smart piston separate from the payload; and effecting the at least one electrical signal to be sent from a set of output terminals of the set of connecting pins to the payload by a set of second electrical connections, wherein the set of output terminals are positioned proximate to a front end of the smart piston adjacent with the payload. This exemplary embodiment or another exemplary embodiment further includes steps of sealing a first chamber, via a gasket, defined between a front end of a canister of the countermeasure expendable and the gasket that houses the payload; and sealing a second chamber, via the gasket, defined between a rear end of the canister of the countermeasure expendable and the gasket that houses a squib of the countermeasure expendable. This exemplary embodiment or another exemplary embodiment further includes a step of biasing the payload, via a biaser of the smart piston, from a main body of the smart piston when the payload and the main body are external of the canister. This exemplary embodiment or another exemplary embodiment further includes steps of removing a port plug of the countermeasure expendable from a canister of the countermeasure expendable; disconnecting the impulse cartridge cup from the at least one electrical port; connecting an external testing unit with the at least one electrical port of the electronic system; sending at least another electrical signal, via the external testing unit, to the at least one electrical port; and communicating with the payload of the countermeasure expendable by the external testing unit, wherein the at least another electrical signal passes through the smart piston.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
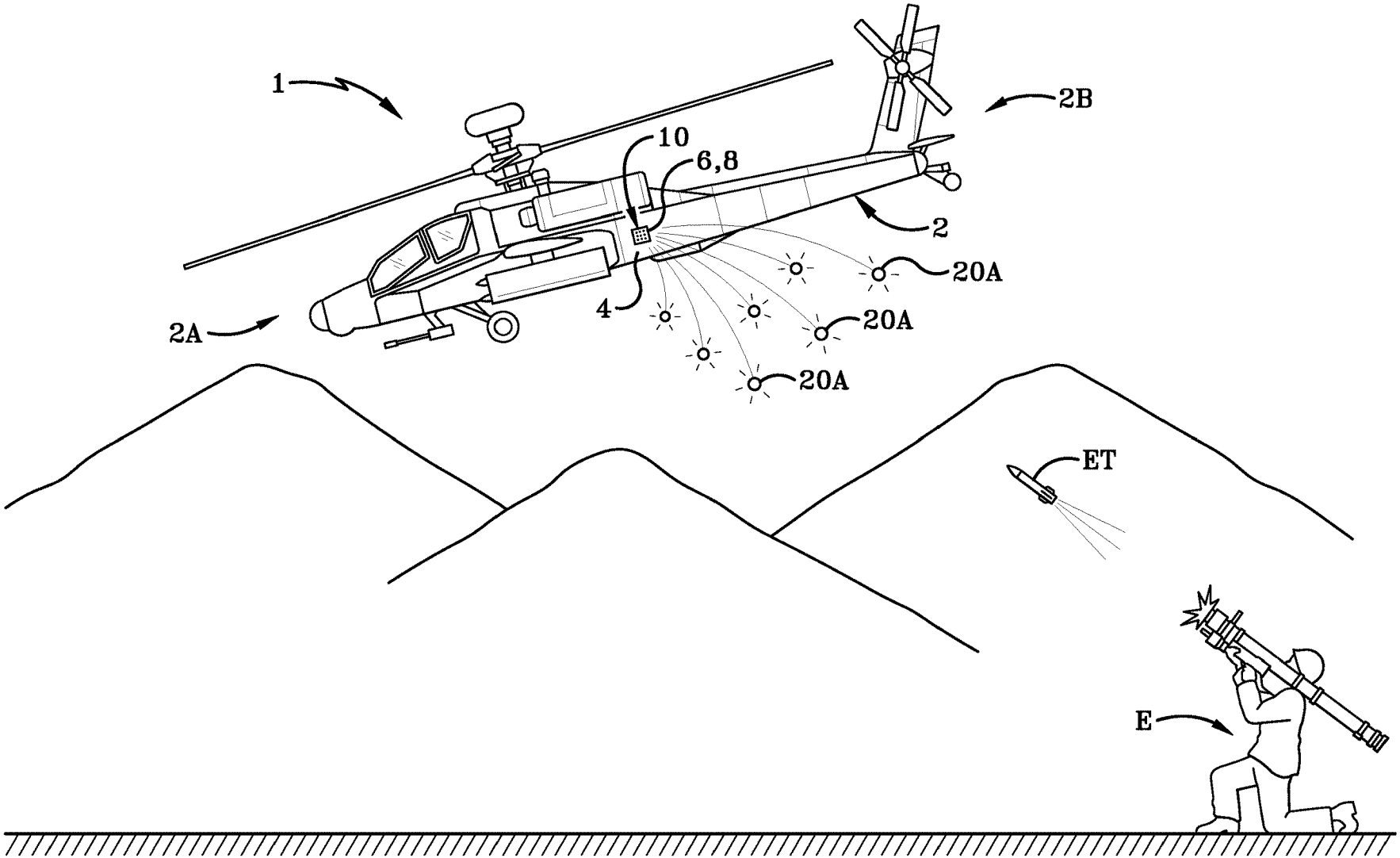
FIG. 1 is a diagrammatic view showing a platform having a CMDS, wherein CMDS is being used to deter an incoming enemy threat via countermeasure material.

FIG. 1 illustrates a platform 1 such as a vehicle, ship or aircraft, which may be manned or unmanned, that includes a main body 2. As used herein, aircraft refers to fixed or rotary wing aircraft as well as UAVs and satellites. The main body 2 has a front end 2A and a rear end 2B longitudinally opposite to the front end 2A. It should be understood that the directions of "front," "rear," "top," "bottom," "right," "left", and other directional derivatives are only used as a directional reference for the main body 2 and its associated components and/or parts described herein and illustrated in FIG. 1.

The platform 1 in this example is an aircraft and includes a sidewall 4 that extends longitudinally between the front end 2A of the main body 2 and the rear end 2B of the main body 2. The sidewall 4 defines an opening 6 that is disposed between the front and rear ends 2A, 2B of the main body 2 providing access to a chamber 8. The opening 6 and the chamber 8 defined by the sidewall 4 is sized and configured to receive a countermeasure dispensing system (hereinafter "CMDS") generally referred to as 10. CMDS 10 operably engages the sidewall 4 of the main body 2 to mechanically fix the CMDS 10 with the platform 1. As illustrated in FIG. 1, the CMDS 10 is in line with the sidewall 4 of the main body 2 such that the CMDS 10 is even with the mold line of the platform 1 for aerodynamic purposes. Upon mounting the CMDS 10, the CMDS 10 is electrically connected to a legacy wiring harness (not illustrated) that is provided in the platform 1 to provide power and communication to some or all electrical components in the CMDS 10, which is described in more detail below.

Prior to military operation or an aerial mission of the platform 1, the CMDS is pre-loaded with a set of countermeasure expendables 20. Each countermeasure expendable of the set of countermeasure expendables 20 is loaded with flare and/or chaff material 20A for countermeasure purposes. In addition, each countermeasure expendable of the set of countermeasure expendables 20 includes an impulse cartridge for detonating and dispensing the countermeasure material 20A from the platform 1. During military operation, the countermeasure material 20A (e.g., flare and/or chaff material) provides a distraction to an incoming enemy threat "ET", initiated by an enemy "E", where the incoming enemy threat "ET" is diverted to the flare and/or chaff material 20A while allowing the platform 1 to remain unscathed. During the military operation or the aerial mission, the platform 1 may receive a warning from an on-board electronic warfare (EW) system regarding the incoming enemy threat "ET" approaching the platform 1. Upon a determination made by the on-board EW system and/or an operator, the CMDS 10 dispenses a calculated amount of countermeasure expendables from the set of countermeasure expendables 20 that are disposed underneath, behind, or to the side of the platform 1. In addition, the CMDS 10 may also be provided along any suitable location of the platform 1 other than sidewall 4 of the main body 2. In one exemplary embodiment, a CMDS may be provided within a wing of an aircraft. In another exemplary embodiment, a CMDS may be provided in a fuselage or a pod disposed on an aircraft.

It should be understood that the CMDS 10 is logically powered and controlled by an on-board system. The system may include suitable devices and apparatuses that are operably engaged with one another to logically control and power the CMDSs (such as CMDS 10) described and illustrated herein. In the illustrated embodiments, CMDSs described and illustrated herein may be logically powered and controlled by a legacy on-board system retaining a majority of legacy devices and apparatuses that are operably engaged with and in communication with one another. Examples of legacy devices and apparatuses that may be provided in this system include, but not limited to, a cockpit interface, discrete components, serial buses, a programmer, and data links. In another instance, a CMDS described and illustrated herein may be logically powered and controlled by a new on-board system having new devices and apparatuses that are operably engaged with one another.

Moreover, it will be understood that the on-board system may also retain and use legacy components of legacy CMDSs currently available. In one instance, a CMDS described and illustrated herein may maintain a legacy dispenser along with a legacy wiring harness operably engaging the CMDS with the legacy on-board system. In another instance, a CMDS described and illustrated herein may only maintain a legacy wiring harness operably engaging the CMDS with the legacy on-board system. Furthermore, it will be understood that CMDSs described and illustrated herein may also use new components that are not legacy to an aircraft nor a legacy on-board system provided on the aircraft. Such components of CMDS 10 are described in further details below.

Figure 2A:
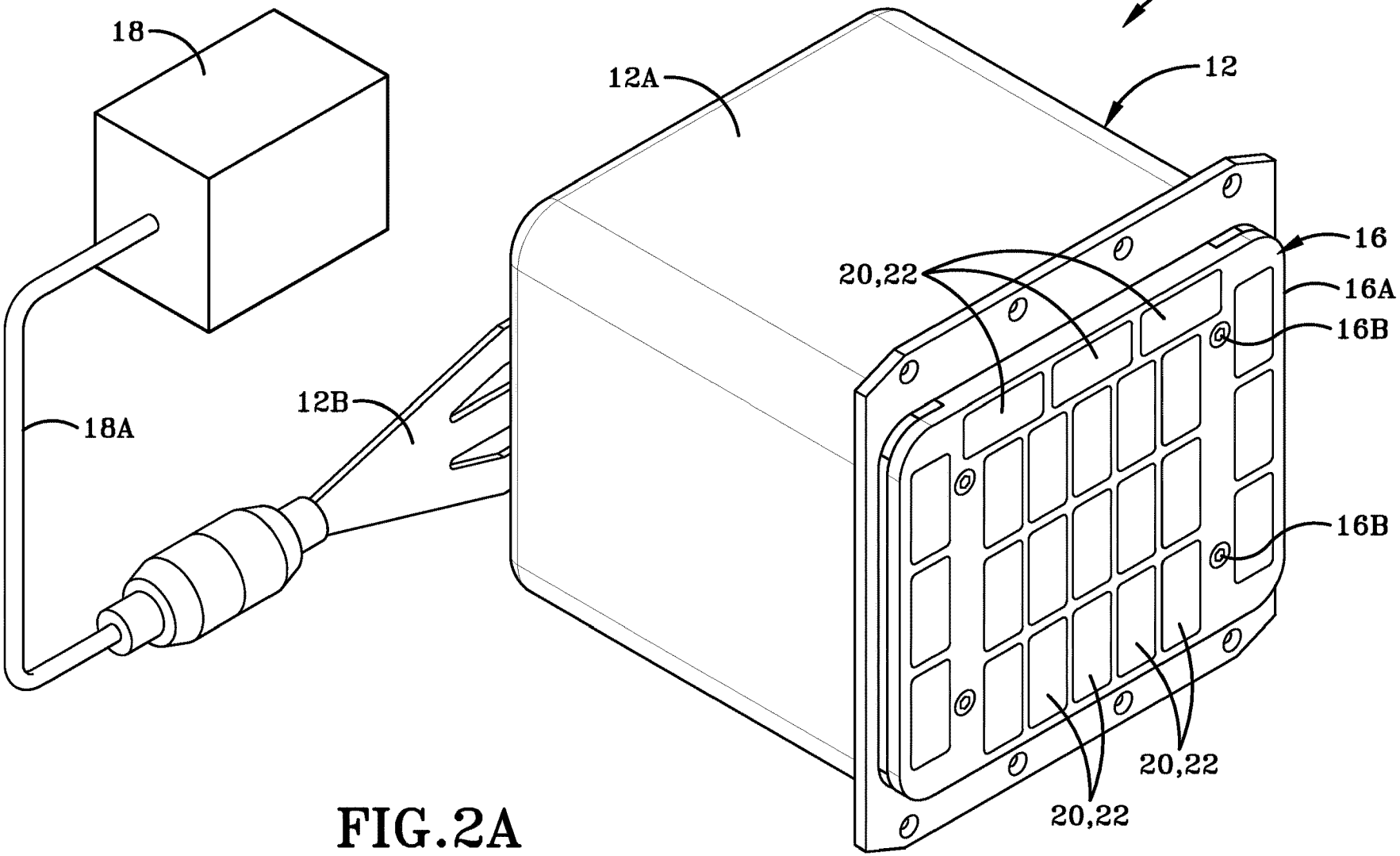
FIG. 2A is a top, front, first side isometric perspective view of CMDS illustrated in FIG. 1, wherein CMDS is loaded with a set of countermeasure expendables.
Figure 2B:
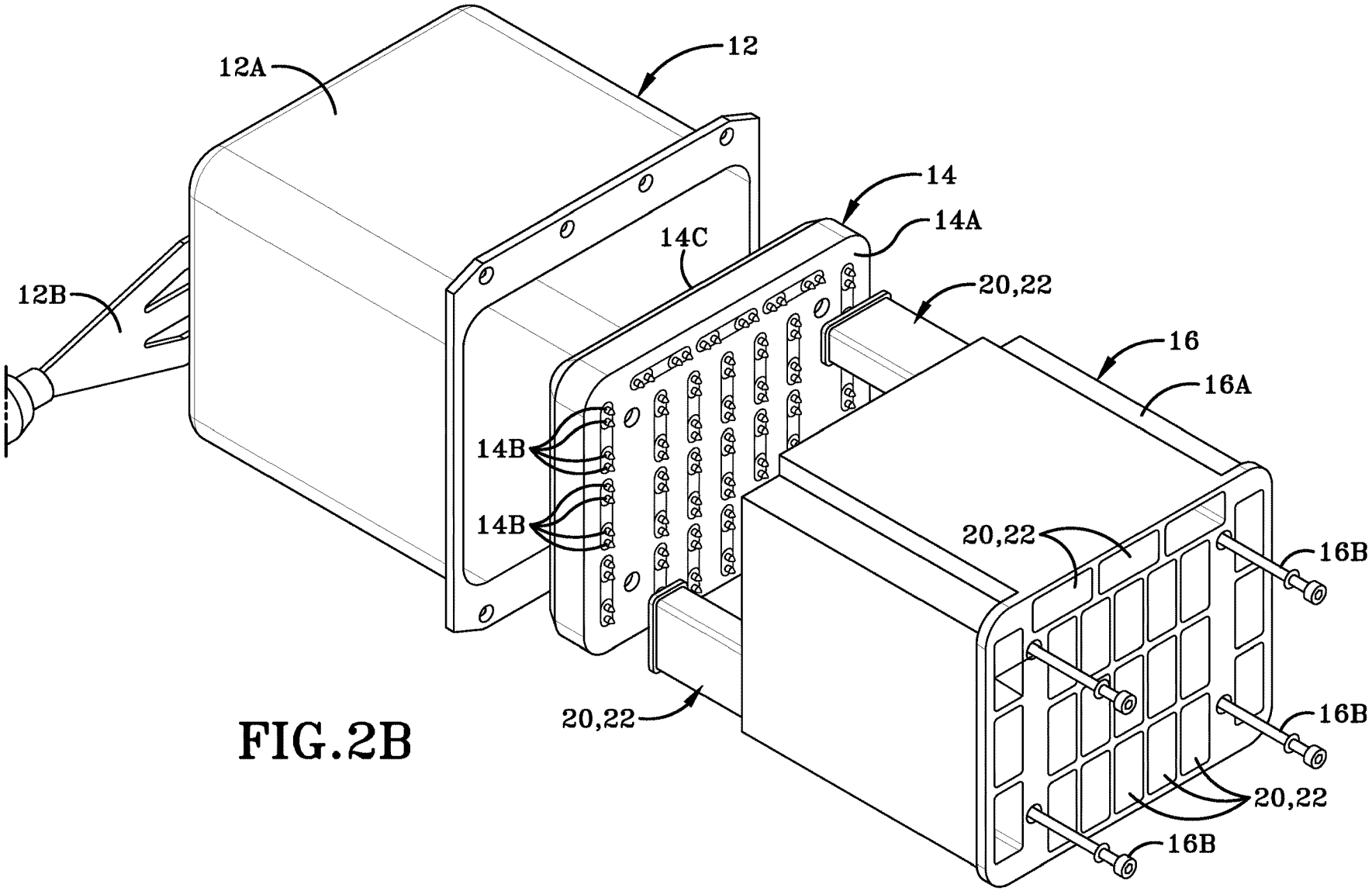
FIG. 2B is an exploded view of the CMDS and the set of countermeasure expendables.

CMDS 10 includes a dispenser assembly 12 that operably engages with the platform 1 inside of the chamber 5 defined in the sidewall 4. As best seen in FIG. 2B, a dispenser 12A of dispenser assembly 12 is configured to hold various assemblies, components, and parts of CMDS 10 inside of the platform 1 for countermeasure operations, which are described in greater detail below. While not illustrated herein, connectors or fasteners may operably engage the dispenser assembly 12 with the platform 1, via a flange of the dispenser 12A, for maintaining the CMDS 10 with the platform 1; such engagement of the dispenser assembly 12 with the platform 1 may be conventional means currently used in the art. In other exemplary embodiments, connectors described previously may be any suitable components that are configured to operably engage a dispenser assembly with a platform for maintaining a CMDS with the platform (e.g., fasteners and other similar components of the like). In one exemplary embodiment, dispenser assembly 12 may be a legacy AN/ALE-47 dispenser used in a standard AN/ALE-47 CMDS. In another exemplary embodiment, dispenser assembly 12 may be a new dispenser assembly that is configured to be used with a new CMDS currently available on platforms discussed herein.

Dispenser assembly 12 also includes a legacy wiring harness 12B that operably engages with the dispenser 12A. Wiring harness 12B is configured to provide an electrical connection between the dispenser 12A and a sequencer of CMDS 10 provided on the platform 1 to enable logic communication between each of the dispenser 12A and the sequencer for dispensing and/or ejecting expendables from the CMDS 10. Such dispensing and ejecting of countermeasure expendables from the CMDS 10 is described in greater detail below.

Referring to FIG. 2B, CMDS 10 also includes a breechplate assembly 14 that operably engages with the dispenser assembly 12, particularly with the dispenser of the dispenser assembly 12. Upon assembly, the entire breechplate assembly 14 is housed inside of the dispenser 12A and provides forty-eight firing lines as compared to the legacy thirty fires lines provided in legacy CMDS. Such parts and components of the breechplate assembly 14 are discussed in greater detail below.

Breechplate assembly 14 includes a faceplate 14A. As best seen in FIG. 2B, faceplate 14A operably engages with the dispenser 12A inside of the dispenser 12A. As described in greater detail below, faceplate 14A also operably engages with a magazine assembly of CMDS and each countermeasure expendable of the set of countermeasure expendables 20 once CMDS 10 is assembled and loaded into the platform 1.

Breechplate assembly 14 also includes a set of first pin mechanisms 14B that operably engages with the faceplate 14A. In the illustrated embodiment, the set of firing pin mechanisms 14B is configured to operably engage with a set of countermeasure expendables (e.g., the set of countermeasure expendables 20) once loaded into the CMDS 10, which is described in more detail below. The set of firing pin mechanisms 14B may be any suitable firing pin mechanisms 14B that are capable of initiating impulse cartridges to dispense countermeasure material from countermeasure expendables known in the art. In one exemplary embodiment, a set of firing pin mechanisms that may be used include firing pin mechanisms described and illustrated in U.S. patent application Ser. No. 17/345,551. In another exemplary embodiment, a set of firing pin mechanisms that may be used include firing pin mechanisms described and illustrated in U.S. patent application Ser. No. 18/045,194. While not illustrated herein, the faceplate 14A may be configured to house any suitable electrical connections and/or electrical wiring that operably engages with each firing pin mechanism of the set of firing pin mechanisms 14B. In one exemplary embodiment, the faceplate 14A described and illustrated herein may define cavities and/or recesses to accommodate and/or house any suitable electrical connections and/or electrical wiring that operably engages with each firing pin mechanism of the set of firing pin mechanisms.

Breechplate assembly 14 may also include a rear cover plate 14C that operably engages with the faceplate 14A via connectors (not illustrated). In the illustrated embodiment, rear cover plate 14C is configured to cover and protect a rear surface of the faceplate 14A along with any electrical connections and/or wires that electrically connect to the set of firing pin mechanisms 14B. Upon assembly, the rear cover plate 14C also operably engages with the dispenser 12A inside of said dispenser 12A.

CMDS 10 also includes a magazine assembly 16 that operably engages with the dispenser assembly 12 and the breechplate assembly 14. As best seen in FIG. 2B, magazine assembly 16 is configured to be attached with the breechplate assembly 14 and hold the set of countermeasure expendables 20. Once assembled, the breechplate assembly 14 and the magazine assembly 16 are operably engaged with the dispenser 12A and housed inside of the dispenser 12A with the set of countermeasure expendables 20 loaded inside of the magazine assembly 16. Such components and parts that make up the magazine assembly 16 are described in more detail below.

Magazine assembly 16 includes a magazine 16A. As best seen in FIG. 2B, magazine 16A operably engages with the breechplate assembly 14 and is configured to hold the set of countermeasure expendables 20. More particularly, the magazine 16A operably engages with the faceplate 14A and houses each countermeasure expendables of the set of countermeasure expendables 20. Prior to operably engaging with the faceplate 14A, the set of countermeasure expendables 20 are loaded into the magazine 16A. Once assembled, the breechplate assembly 14 and the magazine assembly 16 operably engage with the dispenser 12A and are housed inside of the dispenser 12A with the plurality of countermeasure expendables 20 being loaded inside of the magazine 16A.

Magazine assembly 16 also includes a set of connectors 16B. As best seen in FIGS. 2A-2B, the set of connectors 16B operably engages the breechplate assembly 14 and the magazine 16A with the dispenser 12A. Upon assembly, a portion of the magazine 16A may protrude outwardly from the dispenser 12A. In one exemplary embodiment, the entire magazine 16A may be disposed inside of the dispenser 12A such that an exterior end or exterior surface of the magazine 16A is flush with a flange of the dispenser 12A upon assembly.

While not illustrated herein, CMDS 10 may include a controller assembly or an embedded fire select multiplexer assembly (EFSM) that operably engages with one or more of the dispenser assembly 12, the breechplate assembly 14, and the magazine assembly 16. If included, controller assembly may also be configured to electrically connect with each firing pin mechanism of the set of firing pin mechanisms 14B for expanding the number of countermeasure expendables from thirty countermeasure expendables in legacy CMDSs (e.g., AN/ALE-47 systems) up to forty-eight countermeasure expendables while using legacy hardware and components. In one example, controller assembly may be controller assembly described and illustrated in U.S. patent application Ser. No. 17/345,551 for expanding the number of countermeasure expendables from thirty countermeasure expendables in legacy CMDSs (e.g., AN/ALE-47 systems) up to forty-eight countermeasure expendables while using legacy hardware and components. In another example, controller assembly may be controller assembly described and illustrated in U.S. patent application Ser. No. 18/045,194 for expanding the number of countermeasure expendables from thirty countermeasure expendables in legacy CMDSs (e.g., AN/ALE-47 systems) up to forty-eight countermeasure expendables while using legacy hardware and components.

CMDS 10 may also include a sequencer 18. As best seen in FIG. 2A, sequencer 18 may electrically connect with the breechplate assembly 14 via the wiring harness 12B of dispenser assembly 12. More particularly, sequencer 18 may electrically connect with each firing pin of the set of firing pins 14B of breechplate assembly 14 via wiring harness 12B of dispenser assembly 12. It should be understood that sequencer 18 may be located at any suitable location on the platform 1 while still being able to electrically connect with the breechplate assembly 14 via the wiring harness 12B of dispenser assembly 12.

As discussed previously, CMDS 10 also includes the set of countermeasure expendables 20 that is loaded into the magazine 16A of magazine assembly 16 for countermeasure operations. Each countermeasure expendable of the set of countermeasure expendables 20 may include countermeasure material (e.g., chaff material, flare material, etc.) for deterring enemy threats away from the platform 1 during combat and/or military operations. Such parts and components of each countermeasure expendable of the set of countermeasure expendables 20 are discussed in greater detail below.

Figure 3:
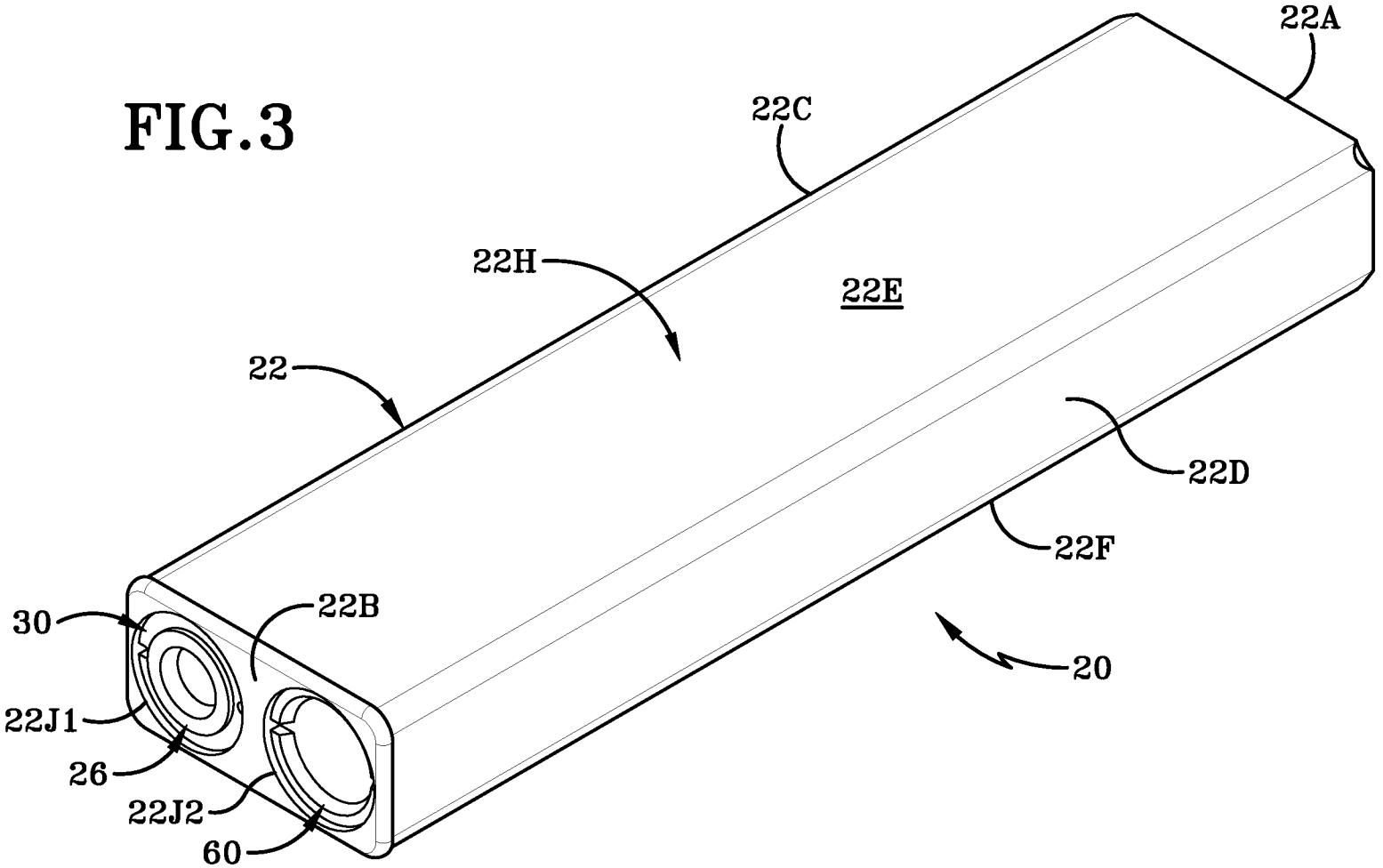
FIG. 3 is a top, rear, second side isometric perspective view of a countermeasure expendable of the set of countermeasure expendables.

Each countermeasure expendable of the set of countermeasure expendable 20 includes a canister 22. As best seen in FIG. 3, canister 22 includes a front wall 22A, and rear wall 22B longitudinally opposite to the front wall 22A, and a longitudinal axis defined therebetween. Canister 22 also includes a first side wall 22C extending between the front wall 22A and the rear wall 22B, a second side wall 22D extending between the front wall 22A and the rear wall 22B and transversely opposite to the first side wall 22C, and a transverse axis defined therebetween. Canister 22 also includes a top wall 22E that is positioned vertically above the front wall 22A, the rear wall 22B, the first side wall 22C, and the second side wall 22D, a bottom wall 22F that is positioned vertically below the front wall 22A, the rear wall 22B, the first side wall 22C, and the second side wall 22D and vertically opposite to the top wall 22E, and a vertical axis defined therebetween.

Figure 5:
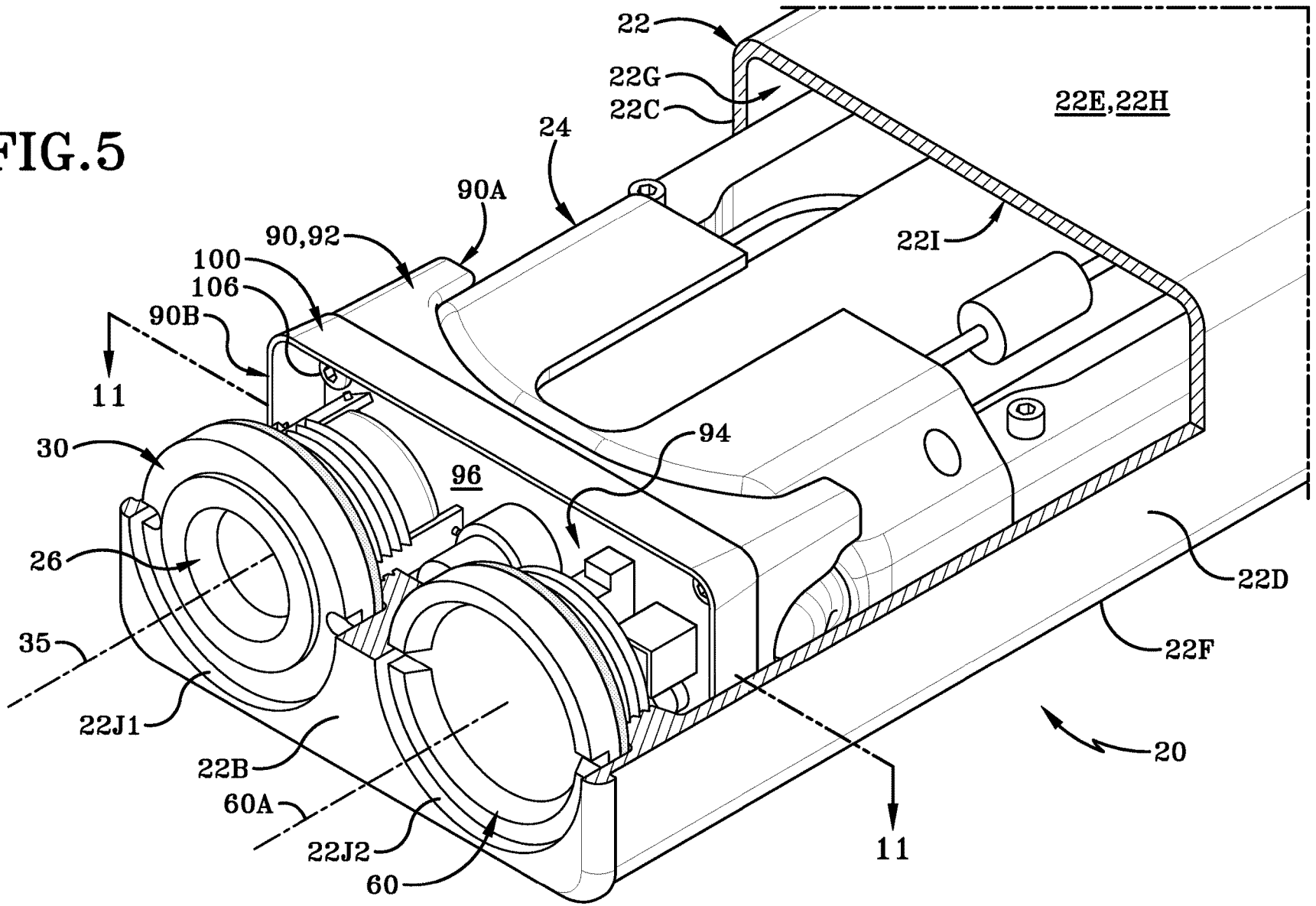
FIG. 5 is a rear cutaway view of a canister of the countermeasure expendable shown in FIG. 3.

Canister 22 also defines a chamber 22G. As best seen in FIG. 5, chamber 22G is collectively defined by the front wall 22A, the rear wall 22B, the first side wall 22C, the second side wall 22D, the top wall 22E, and the bottom wall 22F. Canister 22 also includes an exterior surface 22H that extends along each of the front wall 22A, the rear wall 22B, the first side wall 22C, the second side wall 22D, the top wall 22E, and the bottom wall 22F external to or outside of the chamber 22G. Canister 22 also includes an interior surface 22I that extends along each of the front wall 22A, the rear wall 22B, the first side wall 22C, the second side wall 22D, the top wall 22E, and the bottom wall 22F internal to or inside of the chamber 22G.

Figure 6:
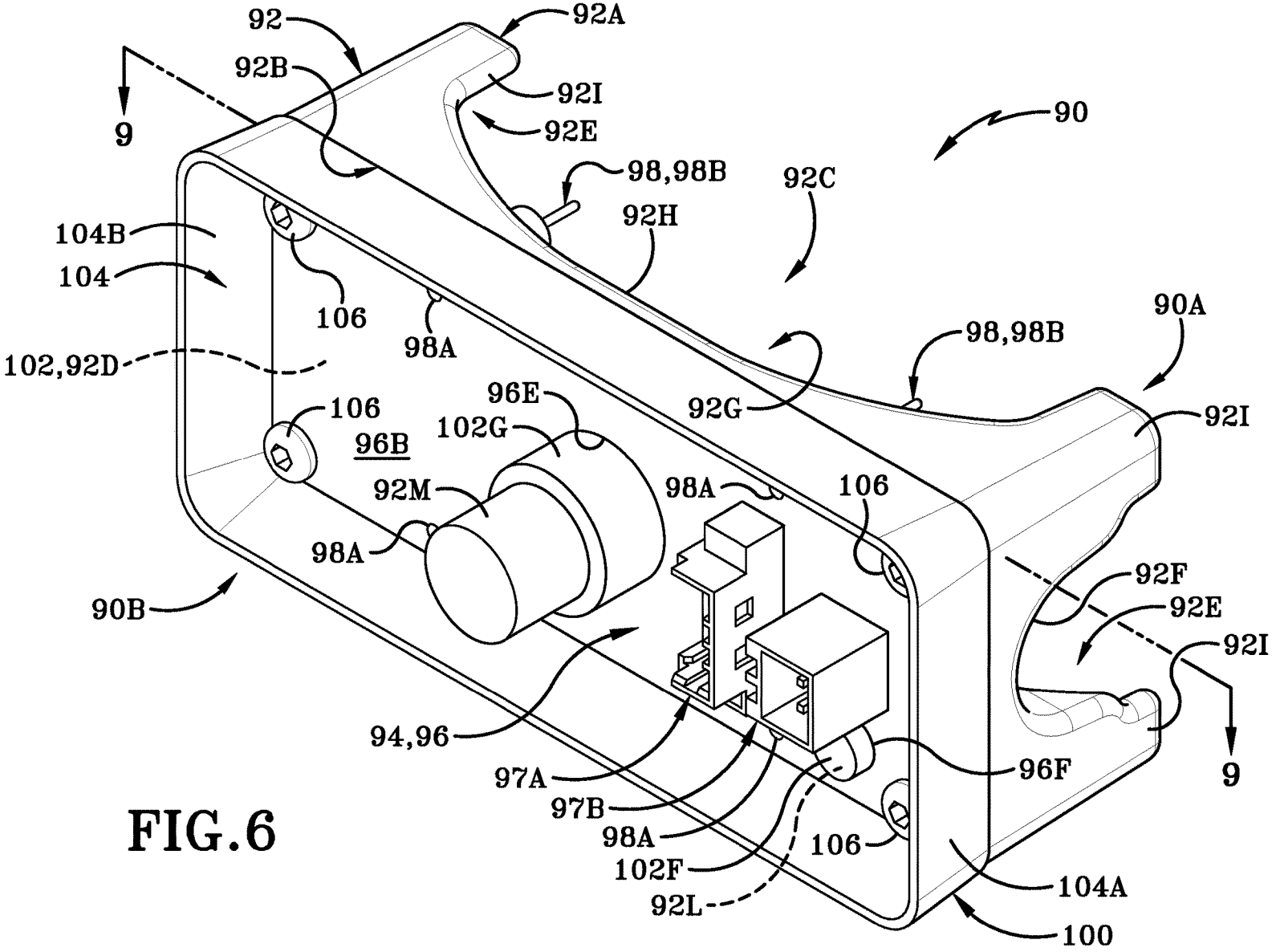
FIG. 6 is a rear, top, second side isometric perspective view of a smart piston of the countermeasure expendable shown in FIG. 3.

Canister 22 also defines at least one threaded opening 22J. As best seen in FIGS. 5-6, canister 22 defines a first threaded opening 22J1 that extends longitudinally from the rear wall 22B towards the front wall 22A. Canister 22 also defines a second threaded opening 22J2 that extends longitudinally from the rear wall 22B towards the front wall 22A. As best seen in FIG. 5, the first threaded opening 22J1 and the second threaded opening 22J2 are adjacent with one another and are transversely opposite with one another. The first threaded opening 22J1 also provides fluid communication between the chamber 22G defined in canister 22 and the external environment surrounding the canister 22. Similarly, the second threaded opening 22J2 also provides fluid communication between the chamber 22G defined in canister 22 and the external environment surrounding the canister 22. Such uses of the first threaded opening 22J1 and the second threaded opening 22J2 are discussed in greater detail below.

Each countermeasure expendable of the set of countermeasure expendables 20 may also include a payload 24. As best seen in FIG. 5, payload 24 may be any suitable countermeasure material that, when ejected from canister 22, diverts or deters one or more enemy threats away from the platform 1. Payload 24 may also include a processing unit or microprocessor that is configured to eject and dispense the countermeasure material at a suitable distance away from the platform 1 dictated by the military operation.

Figure 4:
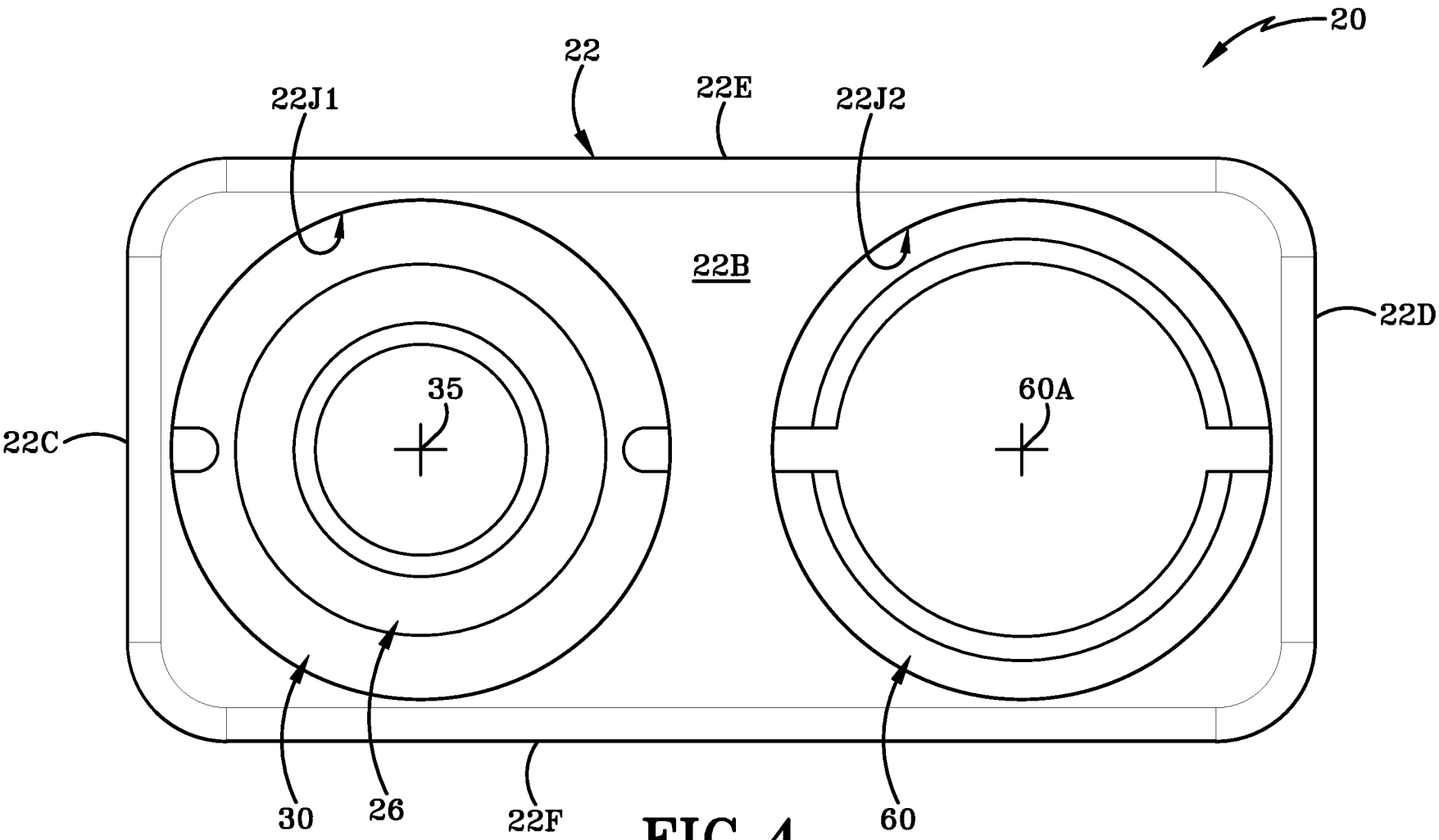
FIG. 4 is a rear elevation view of the countermeasure expendable shown in FIG. 3.

Each countermeasure expendable of the set of countermeasure expendables 20 may also include a squib 26. As best seen in FIGS. 4-5, squib 26 is configured to eject the payload 24 and other components of the countermeasure expendable 20 (discussed in greater detail below) from the canister 22 for dispensing countermeasure material at a suitable distance away from the platform 1 as dictated by the military operation.

Each countermeasure expendable of the set of countermeasure expendables 20 may also include an impulse cartridge cup 30. As best seen in FIG. 5, impulse cartridge cup 30 operably engages with the rear wall 22B of the canister 22. More particularly, impulse cartridge cup 30 may threadably engage with the rear wall 22B of the canister 22 about a rotational axis 35 via the first threaded opening 22J1. Upon engagement with canister 22, impulse cartridge cup 30 is positioned entirely inside of the canister 22 in which impulse cartridge cup 30 impedes communication between the chamber 22G of canister 22 and the external environment of the canister 22 at the first threaded opening 22J1. Upon engagement with canister 22, impulse cartridge cup 30 is also partially positioned inside of chamber 22G of canister 22. As best seen in FIGS. 17A-17B, impulse cartridge cup 30 is configured to receive and house squib 26 for ejecting and dispensing the countermeasure material at a suitable distance away from the platform 1 dictated by the military operation. As discussed in greater detail below, impulse cartridge cup 30 may also be configured to send and/or output at least one signal to a smart piston of countermeasure expendable 20 upon engaging with squib 26.

Each countermeasure expendable of the set of countermeasure expendables 20 may also include a port plug 60. As best seen in FIG. 5, port plug 60 operably engages with the rear wall 22B of the canister 22. More particularly, port plug 60 may threadably engage with the rear wall 22B of the canister 22 about a rotational axis 60A via the second threaded opening 22J2. Upon engagement with canister 22, port plug 60 is positioned entirely inside of the canister 22 in which port plug 60 impedes communication between the chamber 22G of canister 22 and the external environment of the canister 22 at the second threaded opening 22J2. Upon engagement with canister 22, port plug 60 is also partially positioned inside of chamber 22G of canister 22. During operation, port plug 60 may be removed and/or threadably disengaged from the second threaded opening 22J2 for testing operations, which are discussed in greater detail below.

Figure 14:
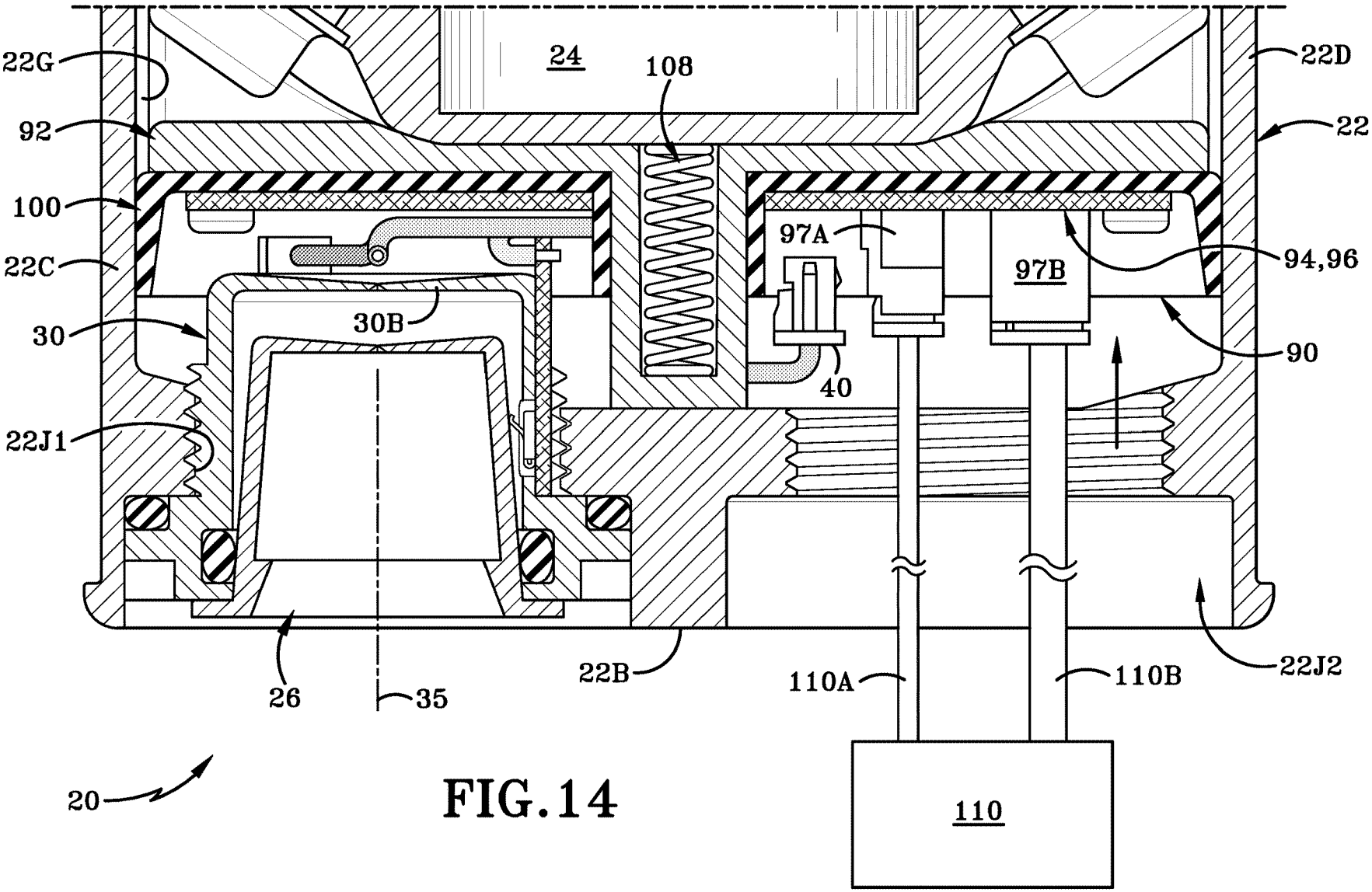
FIG. 14 is another operational view similar to FIG. 12, but an external computer is electrically connected with a processing unit of a payload of the countermeasure expendable via the smart piston.
Figure 15A:
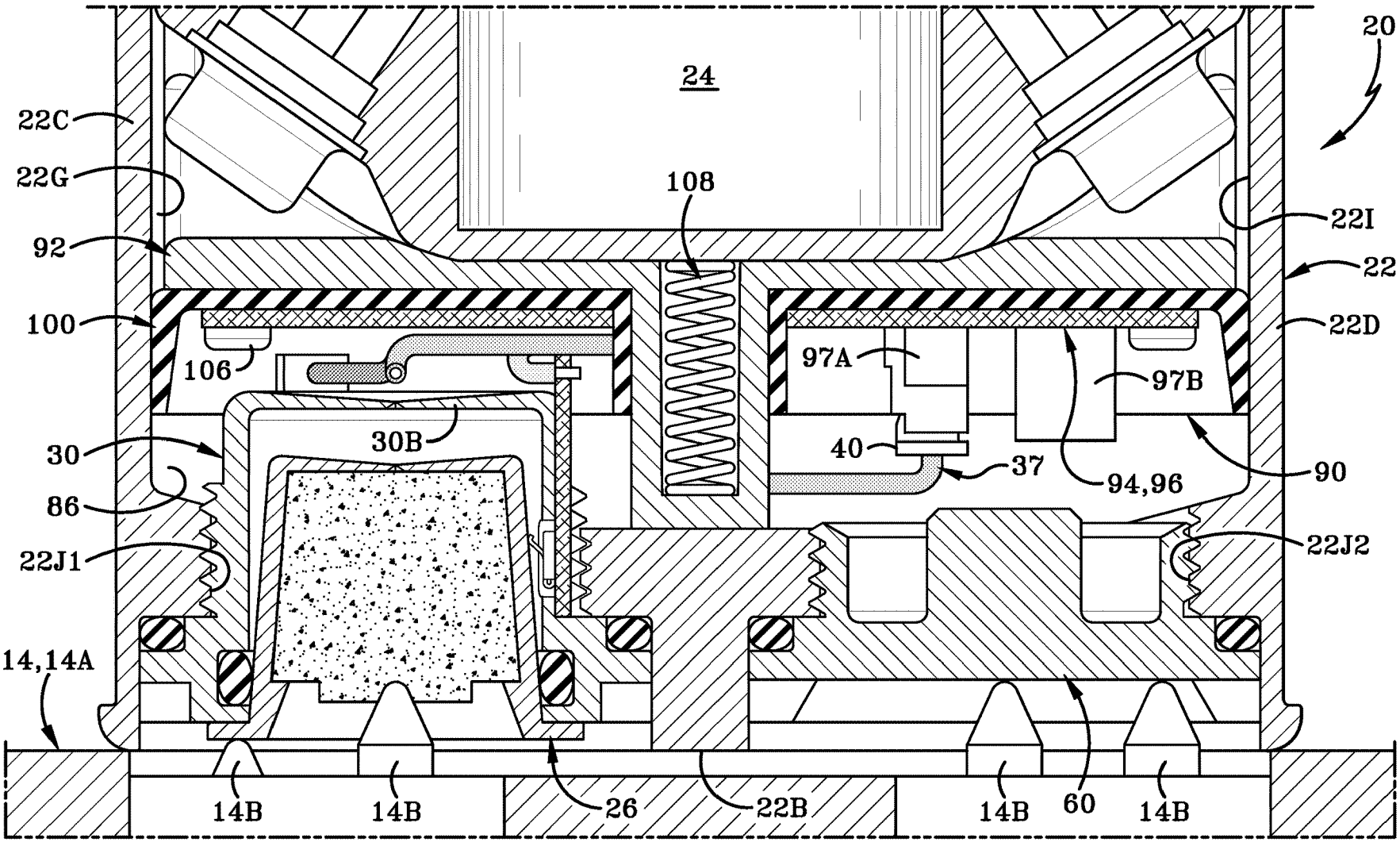
FIG. 15A is an operational view of the countermeasure expendable, wherein the countermeasure expendable is loaded into a magazine of the CMDS and engages with a pair of firing pin mechanisms of a breechplate assembly of the CMDS.
Figure 15B:
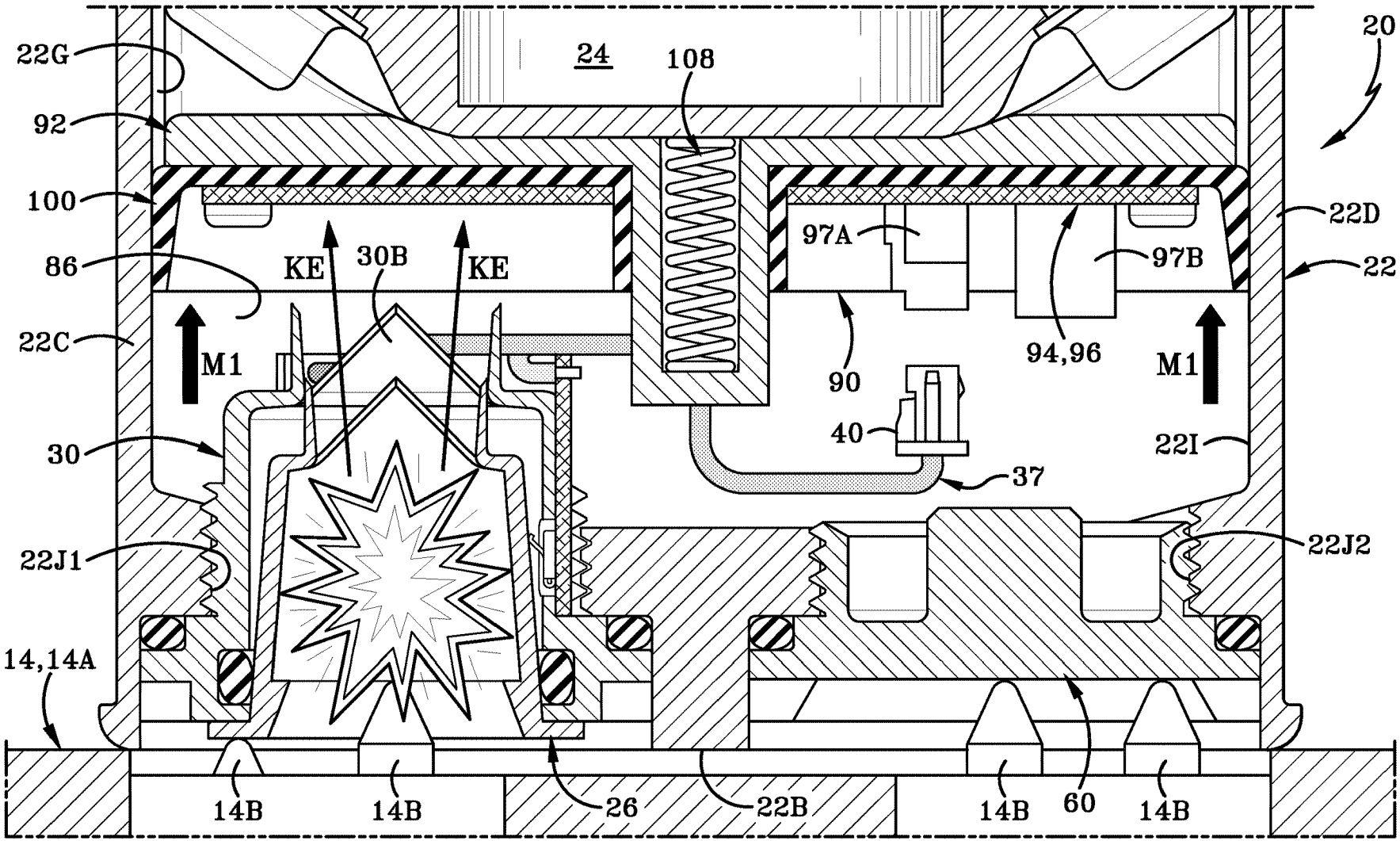
FIG. 15B is another operational view similar to FIG. 15A, but a squib of the countermeasure expendable ignites and generates kinetic energy to eject the payload and the smart piston from the canister.
Figure 15C:
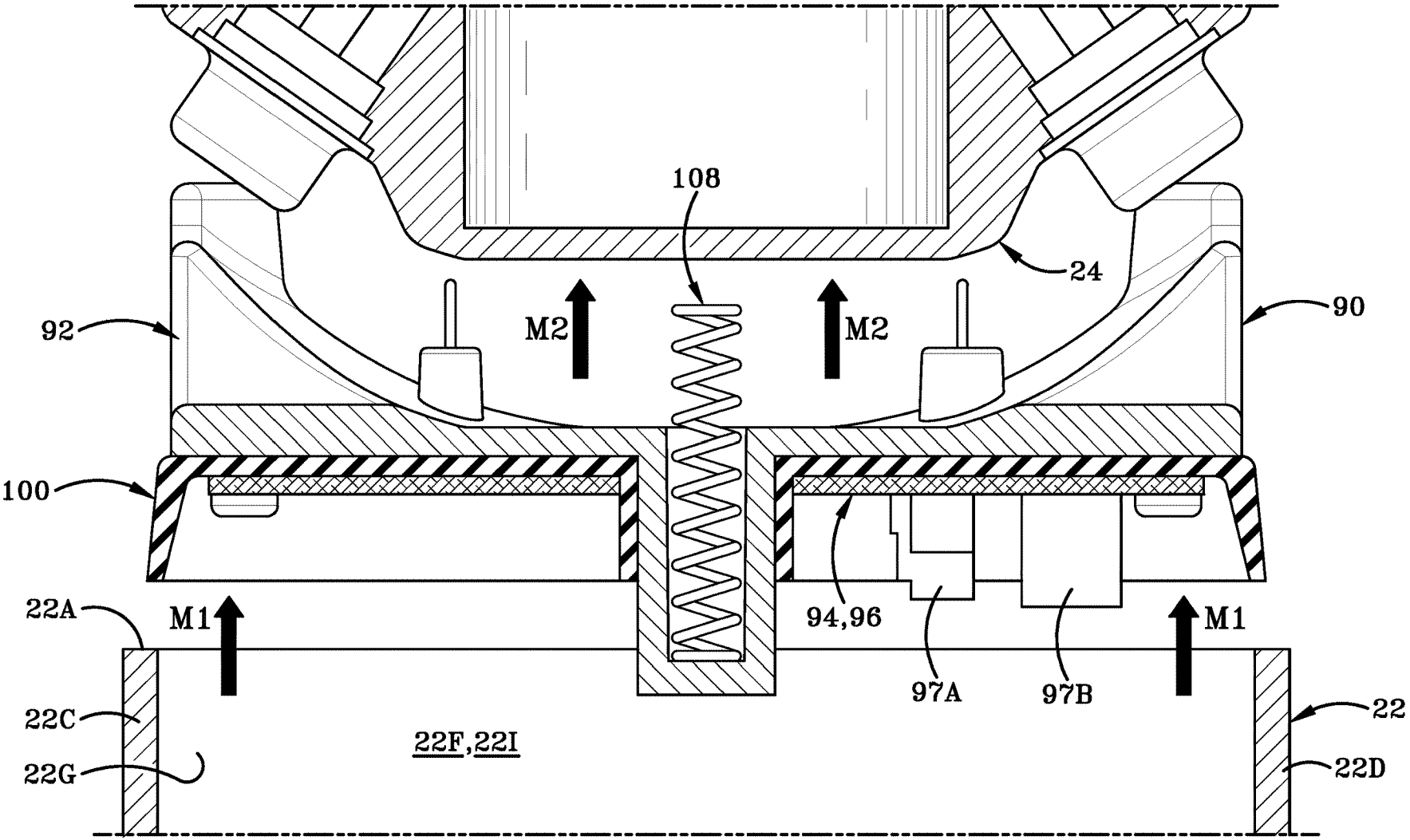
FIG. 15C is another operational view similar to FIG. 15B, but a spring of the smart piston bias the payload outwardly from the platform when the payload and the smart piston are external to the canister.

Each countermeasure expendable of the set of countermeasure expendables 20 may also include a smart piston 90. As best seen in FIGS. 5-6, smart piston 90 includes a front or fore end 90A that is proximate to payload 24 and remote from rear wall 22B. Smart piston 90 also includes a rear or aft end 90B that is opposite to the front end 90A and is proximate to the rear wall 22B and remote from the payload 24. Upon assembly, smart piston 90 operably engages with the canister 22 forwardly of the rear wall 22B, the impulse cartridge cup 30, and the port plug 60. More particularly, smart piston 90 operably engages with the first side wall 22C, the second side wall 22D, the top wall 22E, and the bottom wall 22F inside of the chamber 22G along the interior surface 22I forwardly of the rear wall 22B, the impulse cartridge cup 30, and the port plug 60. As discussed in greater detail below, smart piston 90 enables one or more electrical signals to be passed between the payload 24 and the impulse cartridge cup 30 during testing operations (see FIGS. 12-14) and firing operations (FIGS. 15A-15C). Such parts and components of smart piston 90 are described in greater detail below.

Figure 8:
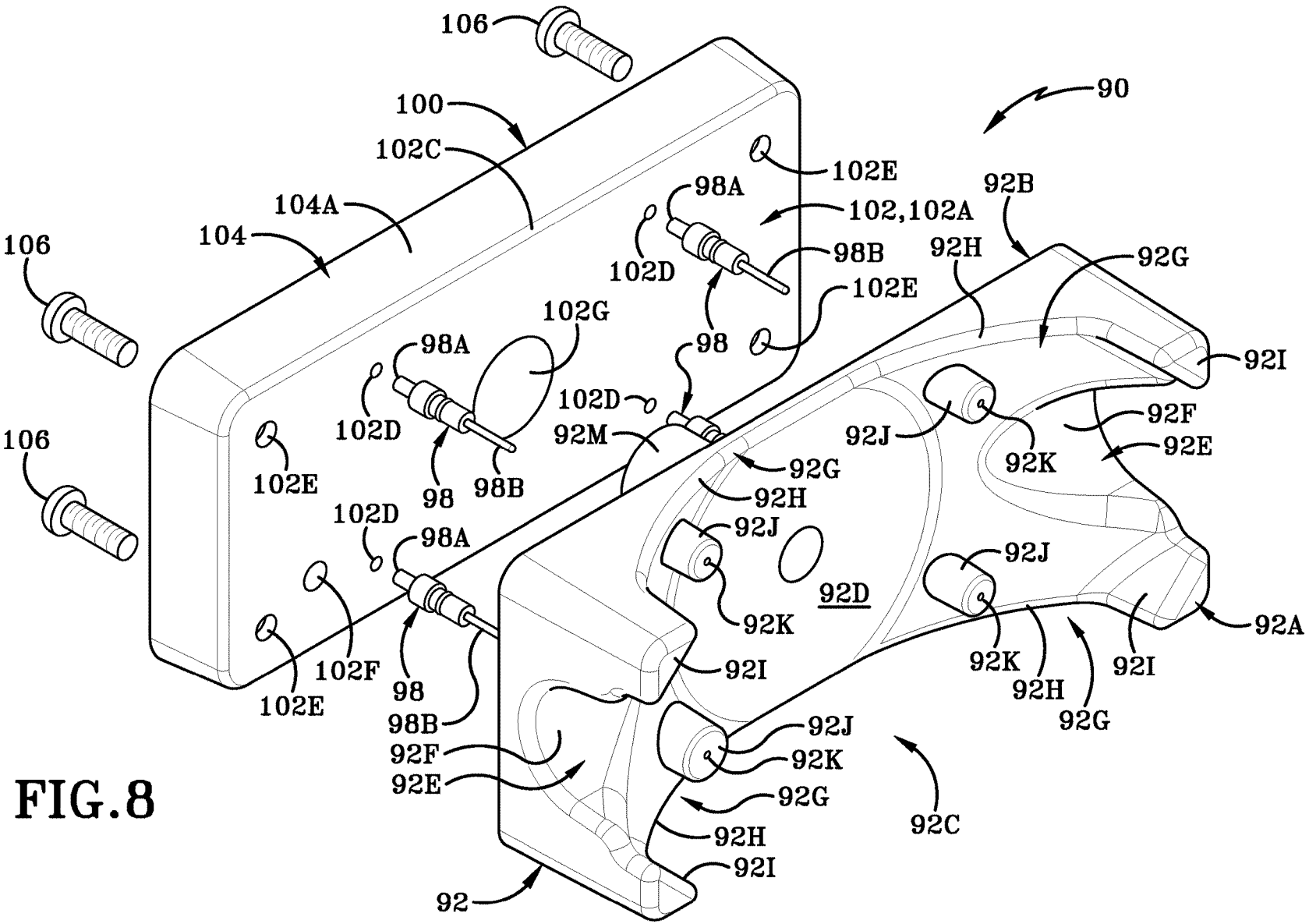
FIG. 8 is another exploded view of the smart piston, wherein the main body of the smart piston, the electronic system of the smart piston, and the gasket of the smart piston are exploded away from one another.

Smart piston 90 includes a main body 92 that is moveable inside of the chamber 22G of canister 22. As best seen in FIG. 8, main body 92 includes a front end 92A, a rear end 92B opposite to the front end 92A, and a transverse axis defined therebetween. Still referring to FIG. 8, main body 92 defines a recess 92C that extends rearwardly from the front end 92A towards the rear end 92B and terminates at a base wall 92D. Still referring to FIG. 8, main body 92 also defines a set of first cavities 92E that extends rearwardly from the front end 92A towards the rear end 92B along a set of first arcuate walls 92F that are positioned forwardly of the base wall 92D. Still referring to FIG. 8, main body 92 also includes a set of second cavities 92G that extends rearwardly from the front end 92A towards the rear end 92B along a set of second arcuate walls 92H that are positioned forwardly of the rear wall 22B.

Main body 92 also includes a set of extension arms 92I. As best seen in FIG. 8, each extension arm of the set of extension arms 92I extends from the rear end 92B towards the front end 92A. Each extension arm of the set of extension arms 92I is separate and spaced apart from one another by the set of first arcuate walls 92F and the set of second arcuate walls 92H defining the set of first cavities 92E and the set of second cavities 92G (see FIG. 8). Such configuration of the main body 92 enables a payload 24 of each countermeasure expendable of the set of countermeasure expendables 20 to operably engage with the main body 92. Particularly, a portion of the payload 24 may be housed inside of the recess 92C, the set of first cavities 92E, and the set of second cavities 92G and be operably engaged with the set of extension arms 92I (see FIG. 10).

Figure 9:
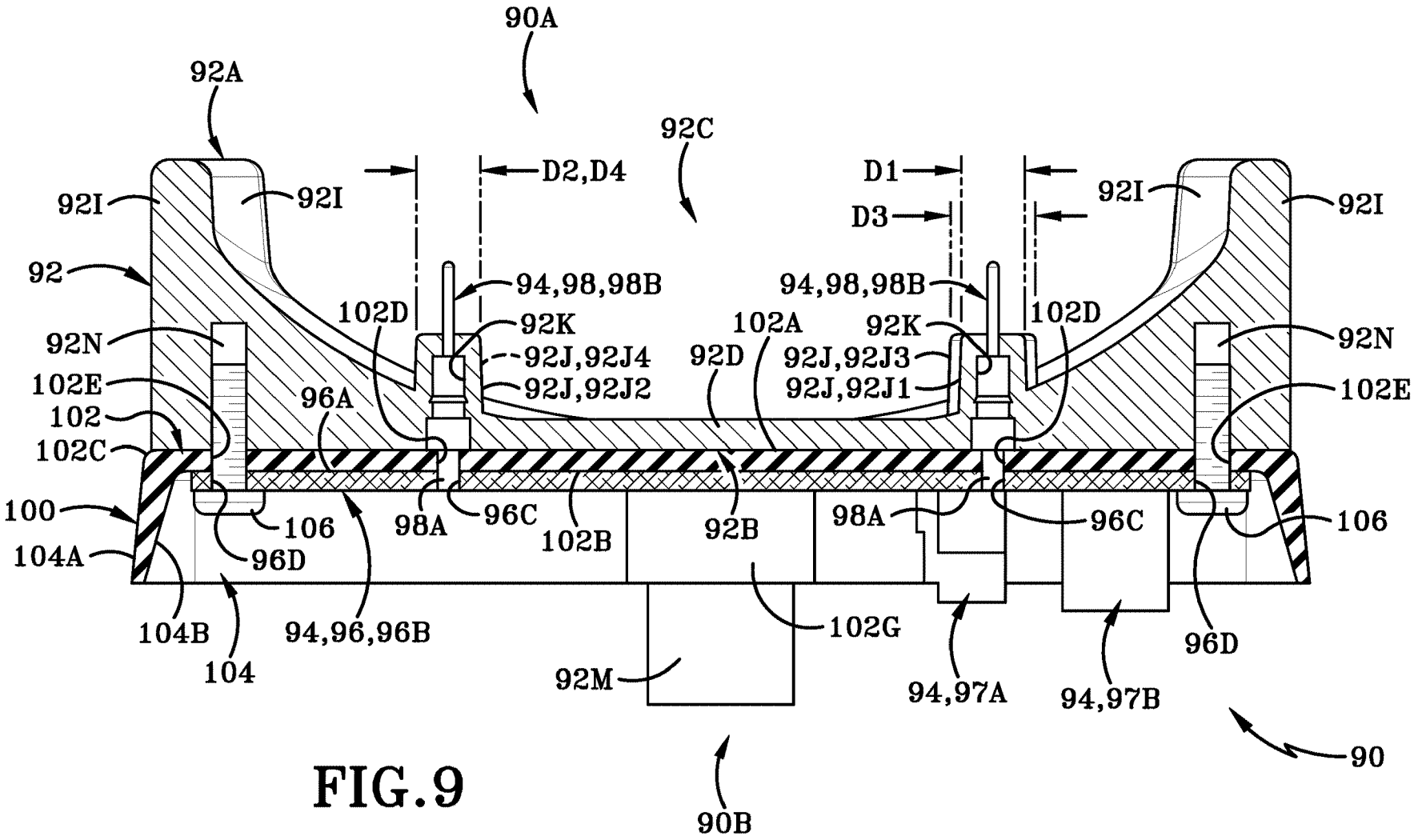
FIG. 9 is a sectional view of the smart piston taken in the direction of line 9-9 in FIG. 6.

Main body 92 also includes a set of extensions 92J. As best seen in FIG. 8, each extension of the set of extensions 92J extends forwardly from the base wall 92D towards the front end 92A. Each extension of the set of extensions 92J is also positioned inside of the recess 92C and internal to the set of extension arms 92I. Main body 92 also define a set of through-holes 92K inside of the set of extensions 92J. As best seen in FIGS. 8 and 9, each extension of the set of extension 92J defines a through-hole 92K from the set of through-holes 92K. Each through-hole of the set of through-holes 92K also extends entirely through a respective extension of the set of extensions 92J where the rear end 92B of main body 92 and the recess 92C of main body 92 are in fluid communication with one another at each through-hole of the set of through-holes 92K.

In the present disclosure, the set of extensions 92J includes a first extension 92J1. As best seen in FIG. 8, the first extension 92J1 is positioned proximate to an upper arcuate wall of the set of second arcuate walls 92H and vertically above the recess 92C. The first extension 92J1 also defines a first diameter D1 that is continuous along the entire length of the first extension 92J1.

The set of extensions 92J also includes a second extension 92J2. As best seen in FIG. 8, the second extension 92J2 is positioned proximate to the upper arcuate wall of the set of second arcuate walls 92H and is longitudinally opposite to the first extension 92J1. The second extension 92J2 also defines a second diameter D2 that is continuous along the entire length of the second extension 92J2. In the present disclosure, the first diameter D1 and the second diameter D2 are equal to one another.

The set of extensions 92J also includes a third extension 92J3. As best seen in FIG. 8, the third extension 92J3 is positioned proximate to a lower arcuate wall of the set of second arcuate walls 92H and directly below the first extension 92J1. The third extension 92J3 also defines a third diameter D3 that is continuous along the entire length of the third extension 92J3. In the present disclosure, the third diameter D3 is greater than the first diameter D1 and the second diameter D2.

The set of extensions 92J includes a fourth extension 92J4. As best seen in FIG. 8, the fourth extension 92J4 is positioned proximate to the lower arcuate wall of the set of second arcuate walls 92H and directly below the second extension 92J2. The fourth extension 92J4 is also longitudinally opposite to the third extension 92J3. The fourth extension 92J4 also defines a fourth diameter D4 that is continuous along the entire length of the fourth extension 92J4. In the present disclosure, the fourth diameter D4 is equal with the first diameter D1 and the second diameter D2 while being less than the third diameter D3.

Figure 10:
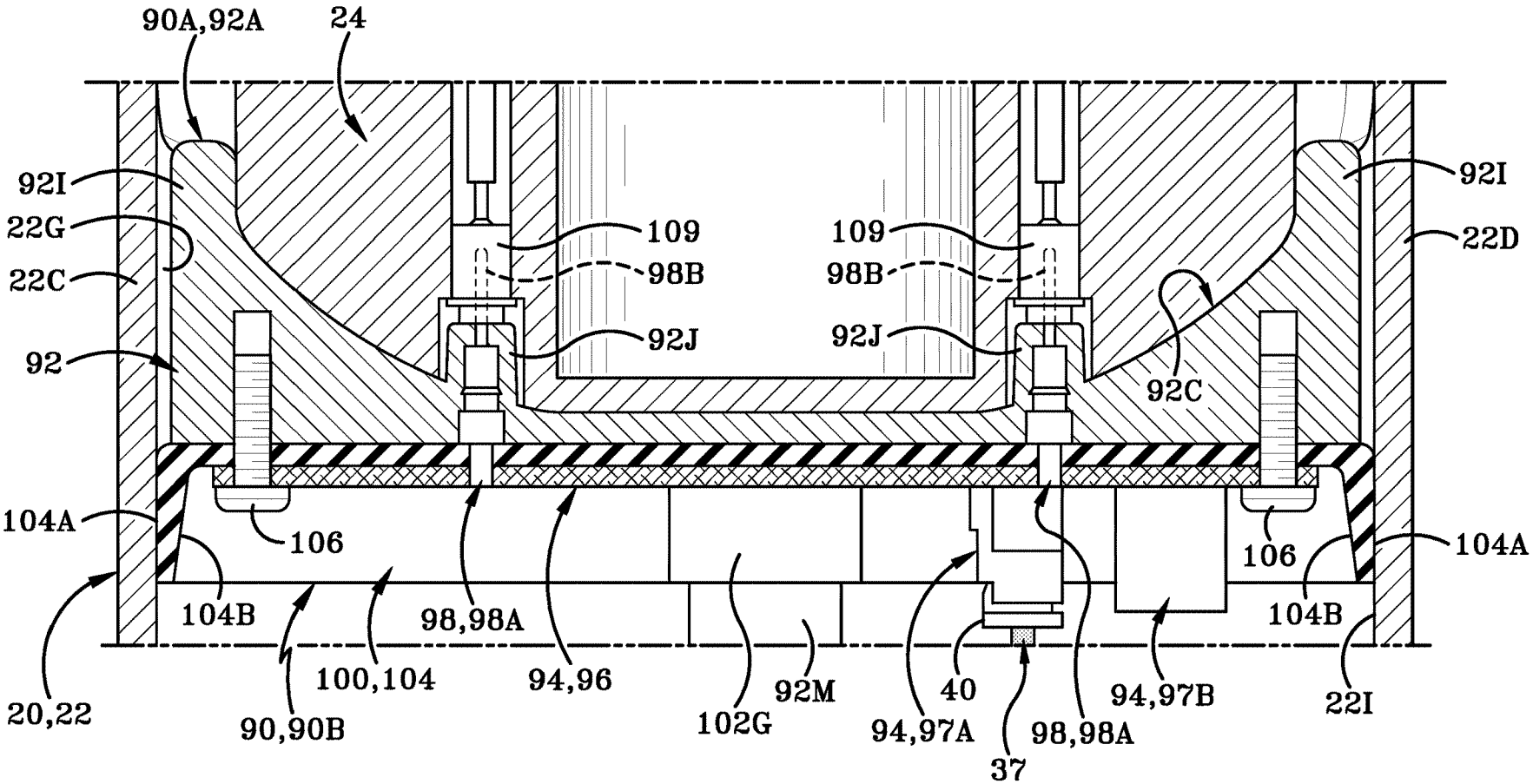
FIG. 10 is a partial top sectional view of the countermeasure expendable shown in FIG. 3.

Such differences in diameters between the first extension 92J1, the second extension 92J2, the third extension 92J3, and the fourth extension 92J4 enables an operator to align the main body 92 with the payload 24 when assembling the countermeasure expandable 20 (see FIGS. 5 and 10). In the present disclosure, payload 24 defines a set of openings 24A that matches with the diameters of the set of extensions 92J to ensure that an operator aligns the main body 92 with the payload 24 when assembling the countermeasure expandable 20. As such, payload 24 defines an opening of the set of openings 24A that is greater than the remaining openings of the set of openings 24A to ensure the operator inserts the third extension 92J3 of the main body 92 into the opening of the set of openings 24A that is greater than the remaining openings of the set of openings 24A. While the first extension 92J1, the second extension 92J2, the third extension 92J3, and the fourth extension 92J4 define particular diameters for aligning the main body 92 with the payload 24, any suitable structural configurations may be used for correctly aligning the main body 92 with the payload 24. In one example, each extension of a set of extensions of a main body may define a shape that matches with a respective opening of a set of openings defined in a payload for correctly aligning the main body with the payload.

Main body 92 also includes a protrusion 92L. In the illustrated embodiment, protrusion 92L extends outwardly from the rear end 92B in a rearward direction away from the front end 92A and the rear end 92B. In one exemplary embodiment, protrusion 92L is a solid member of the main body 92. Such use and purpose of protrusion 92L is discussed in greater detail below.

Figure 11:
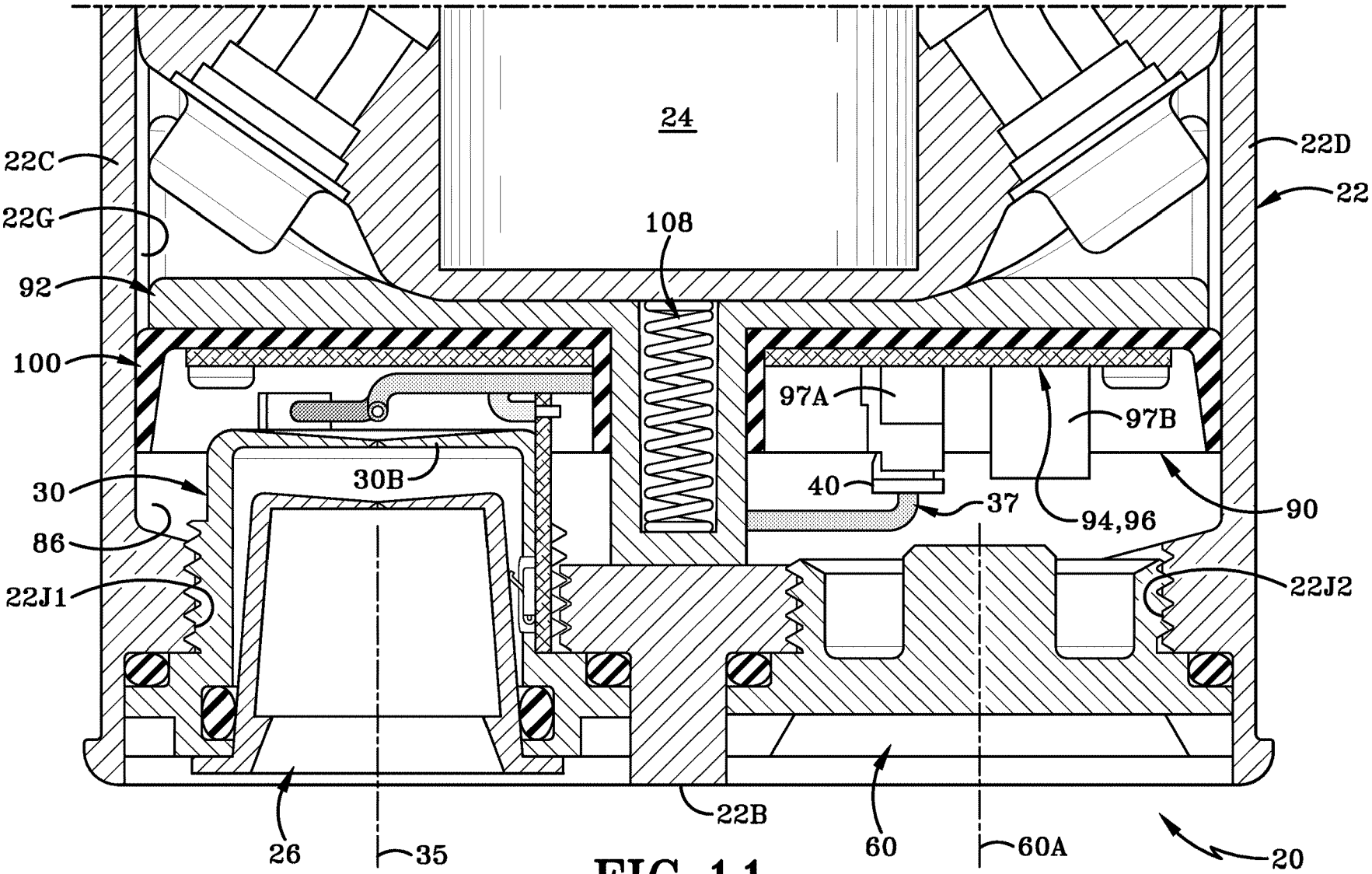
FIG. 11 is a partial sectional view of the smart piston taken in the direction of line 11-11 in FIG. 5.

Main body 92 also includes a projection 92M. As best seen in FIGS. 6,8, and 11, hollow projection 92M extends outwardly from the rear end 92B in a rearward direction away from the rear end 92B. In one exemplary embodiment, projection 92M is a hollow member of the main body 92 where the interior of the projection 92M is accessible at the base wall 92D inside of recess 92C. Such use and purpose of protrusion 92L is discussed in greater detail below.

Main body 92 also defines a set of attachment openings 92N. As best seen in FIG. 9, each attachment opening of the set of attachment openings 92N extends forwardly into the main body 92 from the rear end 92B towards the front end 92A. More particularly, each attachment opening of the set of attachment openings 92N extends forwardly into a respective extension arm of the set of extension arms 92I from the rear end 92B towards the front end 92A. Such use and purpose of the set of attachment openings 92N is discussed in greater detail below.

Smart piston 90 also includes an electronic system 94 that operably engages with the main body 92. As discussed in greater detail below, electronic system 94 enables the impulse cartridge cup 30 to logically communicate with the processing unit of the payload 24 during testing operations and firing operation. Stated differently, the electronic system 94 enables electrical signals to pass through the smart piston 90 from the impulse cartridge cup 30 to the processing unit of the payload 24 without compromising or hindering the smart piston 90 from retaining the propulsion behind in the smart piston 90 once generated by the squib 26. Such components and parts of the electronic system 94 are described in greater detail below.

Electronic system 94 may include an electronic circuit board (hereinafter "ECB") 96 that operably engages with the main body 92. As best seen in FIG. 9, ECB 96 operably engages with the rear end 92B of the main body 92. ECB 96 also includes a front surface 96A that operably engages with the rear end 92B of the main body 92. ECB 96 also includes a rear surface 96B that is free from engaging with the main body 92 and faces in an opposing direction of the front surface 96A. Still referring to FIG. 9, ECB 96 defines a set of first attachment apertures 96C that extends entirely through ECB 96 from the front surface 96A to the rear surface 96B where the front surface 96A to the rear surface 96B are in fluid communication with one another via the set of first attachment apertures 96C. Still referring to FIG. 9, ECB 96 also defines a set of second attachment apertures 96D that extends entirely through ECB 96 from the front surface 96A to the rear surface 96B where the front surface 96A to the rear surface 96B are in fluid communication with one another via the set of second attachment apertures 96D. Such use and purpose of the set of first attachment apertures 96C and the set of second attachment apertures 96D are discussed in greater detail below.

ECB 96 also defines central aperture 96E. As best in FIG. 11, central aperture 96E extends entirely through ECB 96 from the front surface 96A to the rear surface 96B such that the front surface 96A and the rear surface 96B are in fluid communication with one another at the central aperture 96E. As best seen in FIG. 5, central aperture 96E of ECB 96 is configured to enable at least the hollow projection 92M to pass through ECB 96 when main body 92 and ECB 96 operably engage with one another.

ECB 96 also defines a third attachment aperture 96F. As best in FIG. 6, third attachment aperture 96F extends entirely through ECB 96 from the front surface 96A to the rear surface 96B such that the front surface 96A and the rear surface 96B are in fluid communication with one another at the third attachment aperture 96F. Such use and purpose of the third attachment aperture 96F is discussed in greater detail below.

Electronic system 94 also includes at least one electrical port 97. As best seen in FIG. 6, electronic system 94 includes a first electrical port 97A that electrically connects with ECB 96. First electrical port 97A enables a set of electrical connections to electrically connect the impulse cartridge cup 30 with the electronic system 94. Such first electrical port 97A enables the impulse cartridge cup 30 and the payload 24 to logically communicate with one another by passing through the smart piston 90. In the present disclosure, the first electrical port 97A is configured with a first amperage rating that allows for a suitable amount of power to be sent to a processing unit of the payload 24 for communication purposes. As discussed in greater detail below, the first electrical port 97A may also enable an operator to electrically couple or connect with an external testing unit or computer for enabling communication between the payload 24 and the external testing unit or computer for testing or diagnostic purposes. In this instance, the external testing unit provides a suitable amount of power to the processing unit of the payload 24 for enabling communication between the payload 24 and the external testing unit for testing and diagnostic purposes.

Still referring to FIG. 6, electronic system 94 also includes a second electrical port 97B that electrically connects with ECB 96. Second electrical port 97B enables an external testing unit or computer to electrically connect with electronic system 94 for testing purposes, which are described in greater detail below. In this instance, second electrical port 97B may have a second amperage rating in order for the second electrical port 97B to handle a relatively high input current (e.g., between about 4 amperes up to about 5 amperes). For example, second electrical port 97B may be used to supply power to at least one or more high-power electronics (e.g., RF electronics and/or amplifiers) of the payload 24 to test that the high-power electronics are working properly. In this present disclosure, the second amperage rating of the second electrical port 97B is a greater than the first amperage rating of the first electrical port 97A in order to supply power to the high-power electronics of the payload 24.

In the present disclosure, the second electrical port 97B may also electrically connect with the first electrical port 97A via an open port or terminal of the first electrical port 97A to provide a pass-through connection to avoid communication with the squib 26 and/or impulse cartridge cup 30 (i.e., avoiding detonation of squib 26 during testing operations). In the present disclosure, second electrical port 97B is simply a breakout connection of power and ground connections from the first electrical port 97A to allow a greater power to be transmitted to the payload 24, via an external testing unit or computer 110, while avoiding any communication and/or initiation with the squib 26.

Figure 7:
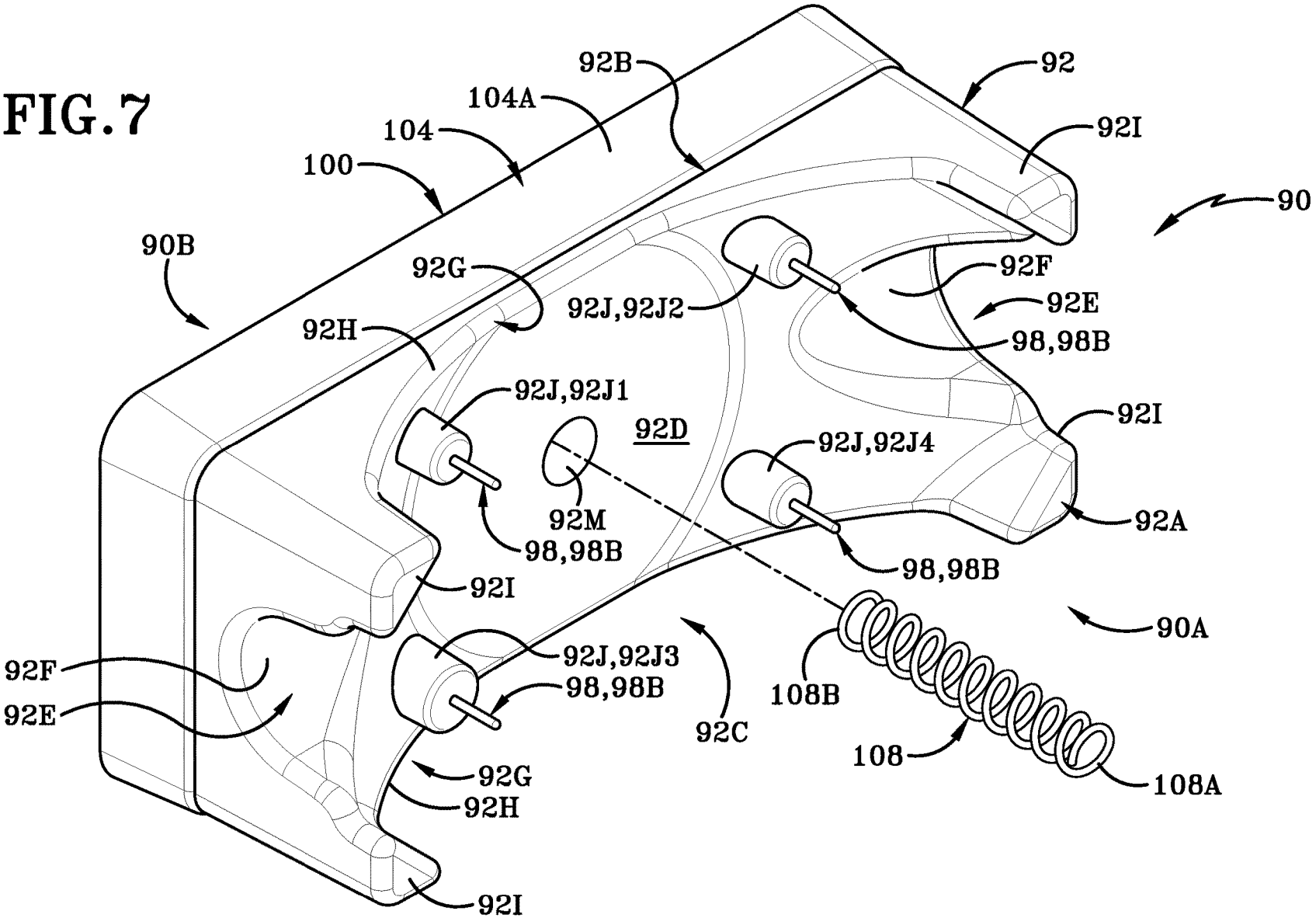
FIG. 7 is an exploded view of the smart piston, wherein a spring of the smart piston is exploded away from a main body of the smart piston, an electronic system of the smart piston, and a gasket of the smart piston.

Electronic system 94 also include a set of connecting pins 98. As best seen in FIGS. 7 and 9, each connecting pin of the set of connecting pins 98 operably engages with main body 92 and ECB 96. As best seen in FIG. 9, an input terminal 98A of each connecting pin of the set of connecting pins 98 electrically connects with ECB 96. It should be understood that the electrical connections between the input terminals 98A of the set of connecting pins 98 and ECB 96 may also electrically connect the input terminals 98A of the set of connecting pins 98 with the first electrical port 97A and the second electrical port 97B. Still referring to FIG. 9, an output terminal 98B of each connecting pin of the set of connecting pins 98 is positioned outside of a respective extension of the set of extension 92J and inside of the recess 92C. Such use and purpose of the set of connecting pins 98 is described in greater detail below.

Smart piston 90 may also include a gasket 100. As best seen in FIG. 9, gasket 100 operably engages with main body 92 and ECB 96 such that the gasket 100 is positioned between the main body 92 and ECB 96 upon assembly. As described in greater detail below, gasket 100 is configured to isolate propulsion and/or kinetic energy (as generated by squib 26 during a firing operation) behind the payload 24 and proximate to the rear end 90B to maximize the kinetic energy produced by squib 26 while protecting the payload 24 and other components fore of the gasket 100 during a firing operations. Such components and features of gasket 100 is described in greater detail below.

Gasket 100 includes a base wall 102 that operably engages with main body 92 and ECB 96. Referring to FIG. 8, base wall 102 includes a front surface 102A that directly abuts and operably engages with the rear end 92B of main body 92 (see FIGS. 8 and 9). Base wall 102 also includes a rear surface 102B that faces in an opposite direction relative to the front surface 102A and directly abuts and operably engages with the front surface 96A of ECB 96 (see FIG. 9). Base wall 102 also includes a peripheral edge 102C that surrounds the base wall 102 and is positioned between the front surface 102A and the rear surface 102B (see FIG. 9).

Still referring to base wall 102, base wall 102 also defines a first set of holes 102D. As best seen in FIGS. 8-9, each hole of the first set of holes 102D extends entirely through the base wall 102 where the front surface 102A and the rear surface 102B are in fluid communication with one another at each hole of the first set of holes 102D. As best seen in FIG. 9, each hole of the first set of holes 102D is sized and configured to receive and house a respective connecting pin of the set of connecting pins 98 of electronic system 94 where the set of connecting pins 98 operably engages with the base wall 102.

Still referring to base wall 102, base wall 102 also defines a second set of holes 102D. As best seen in FIGS. 8-9, each hole of the second set of holes 102E extends entirely through the base wall 102 where the front surface 102A and the rear surface 102B are in fluid communication with one another at each hole of the second set of holes 102E. Referring to FIG. 9, the second set of holes 102E is also defined between the peripheral edge 102C of base wall 102 and the first set of holes 102D. Such use and purpose of the second set of holes 102D is described in greater detail below.

Still referring to base wall 102, base wall 102 also includes a hollow protrusion 102F. As best seen in FIGS. 6 and 8, the hollow protrusion 102F extends outwardly from the base wall 102 in a rearward direction away from the rear surface 102B of base wall 102. As seen in FIG. 8, the internal space defined inside of hollow protrusion 102F is accessible at the front surface 102A of base wall 102. Upon assembly, the hollow protrusion 102F is sized and configured to receive and engage with the protrusion 92L of main body 92 (see FIG. 6). Such engagement between the protrusion 92L and the hollow protrusion 102F provides an additional attachment location between the main body 92 and the gasket 100. As best seen in FIG. 6, hollow protrusion 102F is also configured to pass through ECB 96 and operably engage with ECB 96, via third attachment aperture 96F, upon assembly of smart piston 90.

Still referring to base wall 102, base wall 102 also includes a tubular extension 102G. As best seen in FIGS. 6 and 9, the tubular extension 102G extends outwardly from the base wall 102 in a rearward direction away from the rear surface 102B of the base wall 102. As seen in FIG. 9, the internal passageway defined inside of tubular extension 102G is accessible at the front surface 102A of base wall 102 or behind the base wall 102 at the rear end 90B of smart piston 90. Upon assembly, the tubular extension 102G is sized and configured to receive and engage with the hollow projection 92M of main body 92. Such engagement between the tubular extension 102G and the hollow projection 92M provides an additional attachment location between the main body 92 and the gasket 100. Upon assembly, the tubular extension 102G also operably engages with the ECB 96 inside of the central aperture 96E (see FIG. 6).

Gasket 100 also includes an upright wall 104 that operably engages with the base wall 102. As best seen in FIGS. 8-10, upright wall 104 includes an outer surface 104A that faces outwardly towards the interior surface 22I of the canister 22. Upright wall 104 also includes an inner surface 104B that faces inwardly towards the chamber 22G of the canister 22 and faces in an opposite direction relative to the outer surface 104A. As best seen in FIG. 8, upright wall 104 operably engages with the peripheral edge 102C of base wall 102 where the upright wall 104 extends outwardly from the base wall 102 where the upright wall 104 defines a greater overall width than the base wall 102 when seen from a cross-sectional view (see FIG. 9). Such configuration of the upright wall 104 enables the gasket 100 to provide a fluid tight seal between the outer surface 104A of the gasket 100 and the interior surface 22I of the canister 22 to encapsulate the kinetic energy generated by the squib 26 during a firing operation.

It should be appreciated that gasket 100 may be formed from any suitable material that is capable of providing a fluid tight seal between the outer surface 104A of the gasket 100 and the interior surface 22I of the canister 22 to encapsulate the kinetic energy generated by the squib 26 during a firing operation. In the present disclosure, gasket 100 is made from a resilient material that is capable of providing a fluid tight seal between the outer surface 104A of the gasket 100 and the interior surface 22I of the canister 22 to encapsulate the kinetic energy generated by the squib 26 during a firing operation. Particularly, gasket 100 is made from an elastomer material to provide the fluid tight seal between the outer surface 104A of the gasket 100 and the interior surface 22I of the canister 22.

Smart piston 90 also includes a set of fasteners 106 that operably engages the main body 92, the electronic system 94, and the gasket 100 with one another to form the smart piston 90. As best seen in FIGS. 9-10, the set of fasteners 106 passes through ECB 96, via the set of second attachment apertures 96D, and gasket 100, via the set of second holes 102E, and threadably engages with the main body 92, via the set of attachment openings 92N. It should be appreciated that while a set of fasteners 106 is used to operably engage the main body 92, the electronic system 94, and the gasket 100 with one another to form the smart piston 90, any suitable components and/or materials may be used to operably engage main body 92, the electronic system 94, and the gasket 100 with one another to form the smart piston 90.

Smart piston 90 also includes a biaser 108. As best seen in FIG. 7, biaser 108 includes a first end 108A, a second end 108B that is longitudinally opposite to the first end 108A, and a longitudinal direction defined therebetween. Upon assembly, the first end 108A is adapted to operably engage with payload 24 of the countermeasure expendable 20, and the second end 108B operably engages with the main body 92 inside of the hollow projection 92M (see FIG. 11). As described in greater detail below, biaser 108 is configured to apply an opposing biasing force on the payload 24 and the main body 92 to forcibly separate the payload 24 and the smart piston 90 from one another outside of canister 22. In one example, biaser 108 may be a compression-type spring that exerts an opposing biasing force at each end of the spring.

Figure 12:
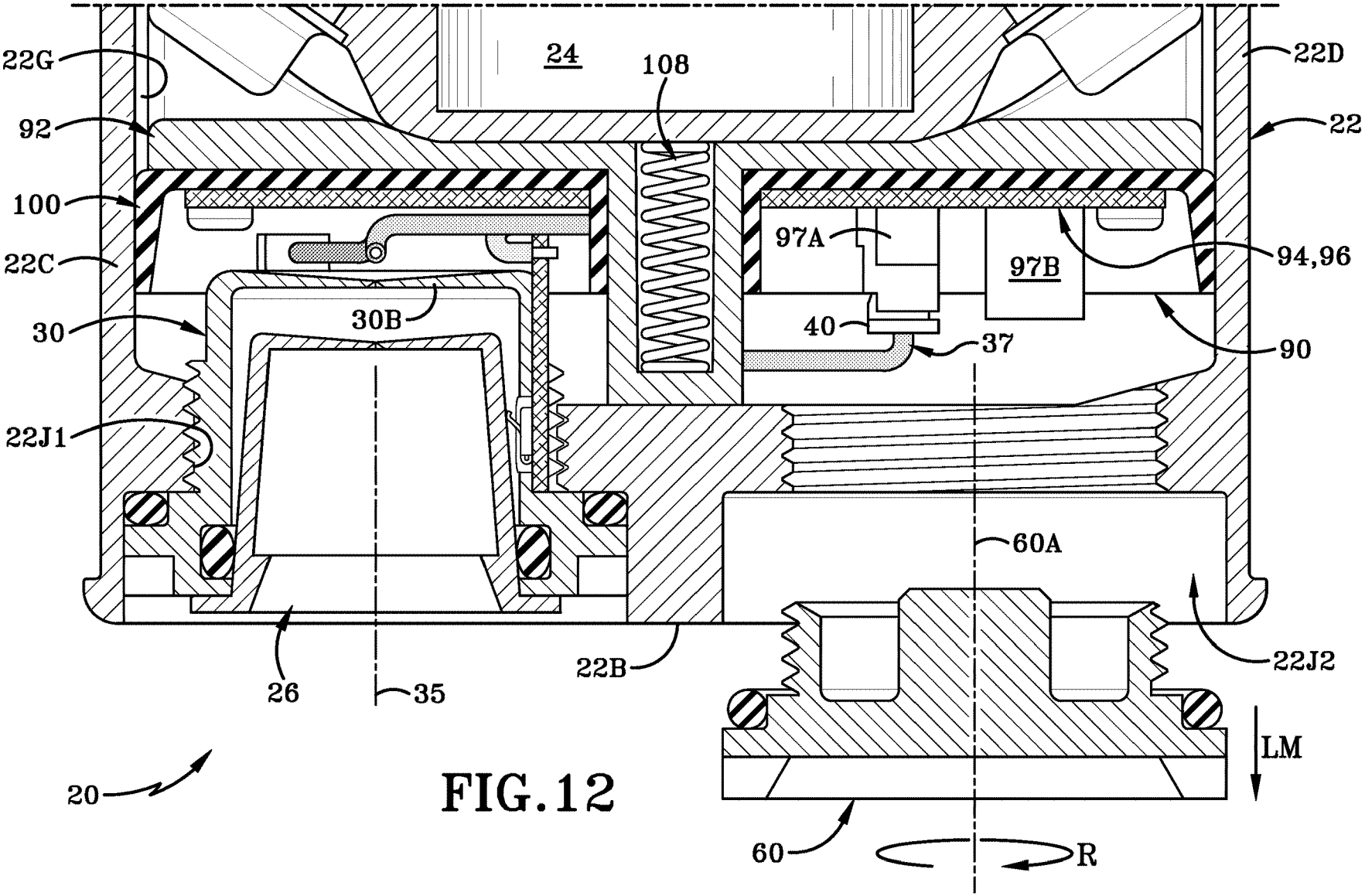
FIG. 12 is an operational view of the countermeasure expendable, wherein a port plug of the countermeasure expendable is removed from the canister of the countermeasure expendable.
Figure 13:
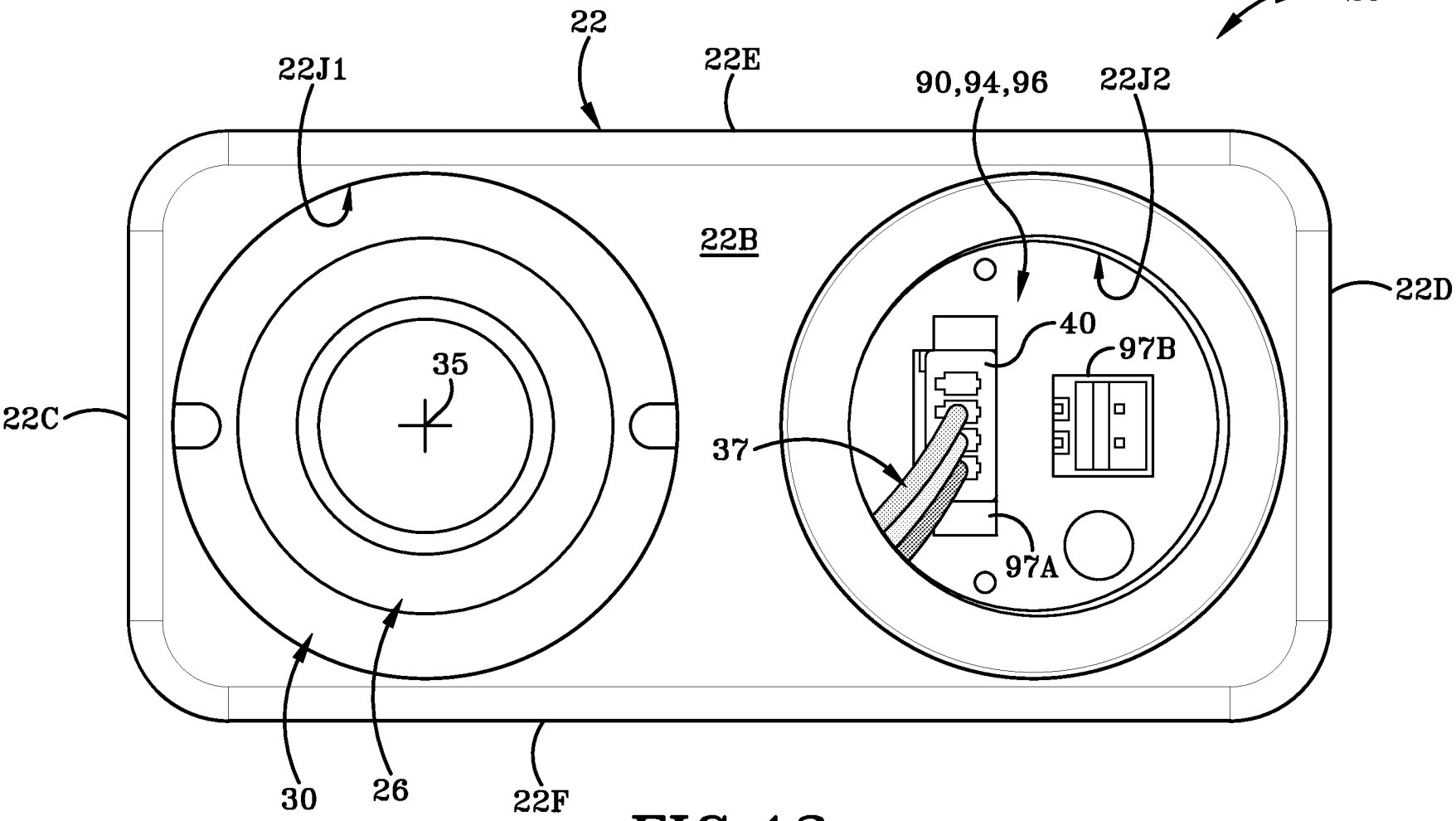
FIG. 13 is a rear elevation view of the countermeasure expendable, wherein the port plug is removed from the canister.

Each countermeasure expendable of the set of countermeasure expendables 20 includes a set of first electrical connections or wires 37. As best seen in FIGS. 11-13, the set of first electrical connections 37 electrically connects the impulse cartridge cup 30 with the first electrical port 97A via an electrical plug 40. Each countermeasure expendable of the set of countermeasure expendables 20 also includes a set of second electrical connections or wires 109. As best seen in FIG. 10, the set of second electrical connections 109 electrically connects the smart piston 90 with the processing unit of the payload 24. Such electrical connections provided in countermeasure expendable 20 enables the payload 24 to logically communicate with the impulse cartridge cup 30, the smart piston 90, and any external testing units that electrically connect with countermeasure expendable 20 via the second electrical port 97B (discussed in greater detail below). Such configuration of the smart piston 90 enables simply pass-through electrical connections without hindering the performance of the smart piston 90 from encapsulating the kinetic energy generated by the squib 26 during a firing operation.

Having now described the components of a countermeasure expendable of the set of countermeasure expendables 20, a method of testing at least one countermeasure expendable of the set of countermeasure expendables 20 in a testing operation is discussed in greater detail below.

Prior to testing at least one countermeasure expendable of the set of countermeasure expendables 20, an operator must remove the port plug 60 from the canister 22. As best seen in FIG. 12, the operator may use a tool to threadably disengage the port plug 60 from the second threaded opening 22J2 by loosening the port plug 60 from the second threaded opening 22J2. Such loosening of the port plug 60 about the rotational axis 60A from the second threaded opening 22J2 is denoted by an arrow labeled "R" in FIG. 12. Once loosened, the operator may then remove and linearly move the port plug 60 from the canister 22; such removal of the port plug 60 is denoted by an arrow labeled "LM" in FIG. 12.

Once removed, the operator may then introduce and connect an external testing unit or computer 110 with the smart piston 90. Prior to connecting the external testing unit 110 with the countermeasure expandable 20, the operator also removes electrical plug 40 from the first electrical port 97A to enable the external testing unit 110 to communicate with the payload 24 for testing purposes. As best seen in FIG. 14, the operator may introduce a communication or first external wire 110A of the external testing unit 110 through the second threaded opening 22J2 and connect the communication wire 110A with the first electrical port 97A. In this instance, the communication wire 110A may include both power and signal capabilities for providing power to payload 24 and signal communication between the external testing unit 110 and the payload 24 for testing operations. Once connected, the operator may then interface with the processing unit of the payload 24 and other various parts and components electrically connected with the electronic system 94. In this instance, however, the power provided through the communication wire 110A is enough to merely communication with processing unit of the payload 24. Such interfacing with the payload 24 may enable the operator to perform various operations and/or tasks on the payload 24 in a testing environment.

As best seen in FIG. 14, the operator may also introduce a power or second external wire 110B of the external testing unit 110 through the second threaded opening 22J2 and connect the power wire 110B with the second electrical port 97B. In this instance, the power wire 110B may include power that is greater than the power supplied by the communication wire 110A for powering on the processing unit of the payload 24 and other various parts and components of the payload 24 for testing purposes. Such use of the power wire 110B during testing operations may be advantageous when the operator desires to power specific power components of the payload 24 (e.g., amplifiers) for detonating and ejecting countermeasure material from the canister 22.

Having previously described the components of a countermeasure expendable of the set of countermeasure expendables 20, a method of firing at least one countermeasure expendable of the set of countermeasure expendables 20 from the platform 1 is discussed in greater detail below.

Prior to a military operation with platform 1, an operator of the CMDS 10 may begin to load the breechplate assembly 14 and the magazine assembly 16 into dispenser 12A of dispenser assembly 12. First, the operator may initially load the breechplate assembly 14 into dispenser 12A of dispenser assembly 12. Once inside of the dispenser 12A, the operator may then operably engage then electrically connect the breechplate assembly 14 with the dispenser assembly 12. In this step, a controller assembly (if included) may also be electrically connected with the dispenser assembly 12. Such connection between the dispenser assembly 12 and the breechplate assembly 14 enables the breechplate assembly 14 to communicate with sequencer 18 provided on the platform 1 via the wiring harness 12B of dispenser assembly 12.

Prior to loading the magazine assembly 16 into the dispenser 12A of the dispenser assembly 12, the magazine 16A is loaded with the set of countermeasure expendables 20. Here, an operator of the CMDS 10 loads each countermeasure expendable of the set of countermeasure expendables 20 into a rear set of apertures defined in the magazine 16A until each countermeasure expendable of the set of countermeasure expendables 20 is fully housed inside of a respective passageway of a set of passageways defined in the magazine 16. It should be noted that additional retaining plates and/or members may be attached to the magazine 16A to keep each countermeasure expendable of the set of countermeasure expendables 20 inside of the magazine 16A.

Once the set of countermeasure expendables 20 are loaded, the magazine 16A may then be loaded into the dispenser 12A of the dispenser assembly 12. Upon being loaded into the dispenser 12A, two pairs of firing pins of the set of firing pin mechanisms 14B may then engage with a respective countermeasure expendable from the set of countermeasure expendables 20. As best seen in FIG. 15A, a first pair of firing pins the set of firing pin mechanisms 14B operably engages with the squib 26, and a second pair of firing pins the set of firing pin mechanisms 14B operably engages with the port plug 60 of the respective countermeasure expendable from the set of countermeasure expendables 20. The remaining pairs of firing pins of the set of firing pin mechanisms 14B also engage with the remaining countermeasure expendables from the set of countermeasure expendables 20. The operator may then operably engage the magazine 16A with the dispenser 12A such that the magazine 16A is held inside of the dispenser 12A and the platform 1. In the illustrated embodiment, the connectors 16B may be threadably engaged with the dispenser 12A to hold the magazine 16A inside of the dispenser 12A.

During a military operation, sequencer 18 may send at least one electrical signal to the breechplate assembly 14 to fire and eject at least one countermeasure expendable from the set of countermeasure expendables 20 to perform a countermeasure operation. As best seen in FIG. 15B, the sequencer 18 sends at least one electrical signal to the breechplate assembly 14, particularly the first pair of firing pins from the set of firing pin mechanisms 14B, to ignite squib 26. Upon ignition, the squib 26 creates kinetic energy that is directed through the impulse cartridge cup 30 and towards the smart piston 90 into a combustion chamber 86 defined between the impulse cartridge cup 30 and the smart piston 90. Such kinetic energy is denoted by arrows labeled "KE" in FIG. 15B. The kinetic energy is also maintained between the impulse cartridge cup 30 and the smart piston 90 to ensure that a substantial amount of the kinetic energy is used to eject the payload 24 and the smart piston 90 from the canister 22. The kinetic energy generated by the squib 26 then collectively moves the payload 24 and the smart piston 90 through the canister 22 towards the front wall 22A away from the rear wall 22B; such collective movement of the payload 24 and the smart piston 90 through the canister 22 is denoted by arrows labeled "M1" in FIG. 15B.

Once the payload 24 and the smart piston 90 are positioned outside of the canister 22, biaser 108 will bias the payload 24 outwardly away from the smart piston 90 (FIG. 15C). Such biasing by the biaser 108 pushes the payload 24 further away from the platform 1 to overcome external environment factors surrounding the platform 1, such as external wind gusts, lack of gravity applied against payload 24 (i.e., ejected when platform 1 is inverted), and other various external environment factors. Such biasing movement of the payload 24 and the smart piston 90 away from one another via the biaser 108 is denoted by arrows labeled "M2" in FIG. 15C. It should be noted that the kinetic energy generated by the squib 26 may also be a suitable amount of energy for ejecting the payload 24 away from the platform 1 in addition to the biasing force applied by the biaser 108.

Figure 16:
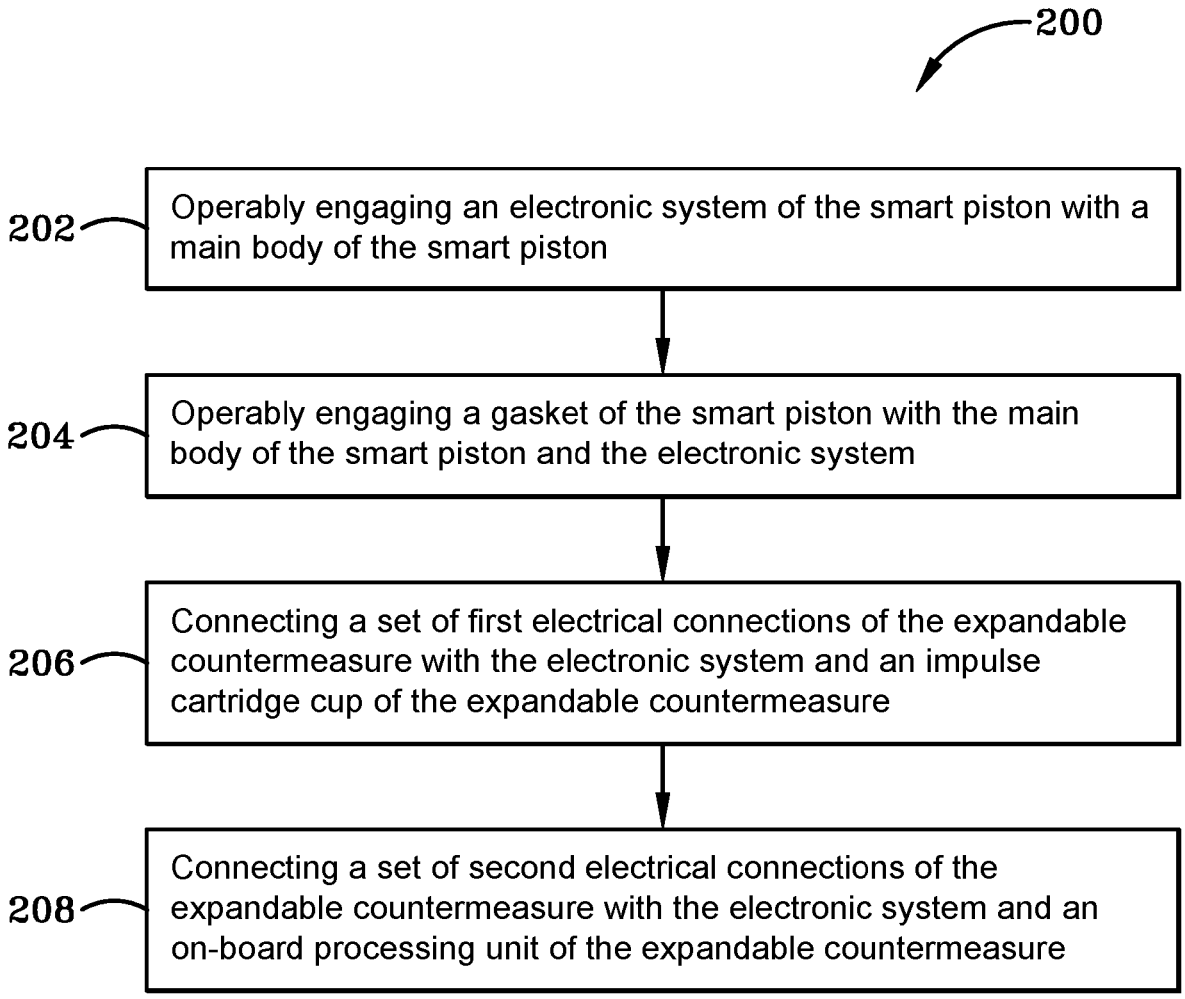
FIG. 16 is an exemplary method flowchart.

FIG. 16 illustrates a method 200 of manufacturing a smart piston of an countermeasure expendable. An initial step 202 of method 200 includes operably engaging an electronic system of the smart piston with a main body of the smart piston. Another step 204 of method 200 includes operably engaging a gasket of the smart piston with the main body of the smart piston and the electronic system. Another step 206 of method 200 includes connecting a set of first electrical connections of the countermeasure expendable with the electronic system and an impulse cartridge cup of the countermeasure expendable. Another step 208 of method 200 includes connecting a set of second electrical connections of the countermeasure expendable with the electronic system and an on-board processing unit of the countermeasure expendable.

Figure 17:
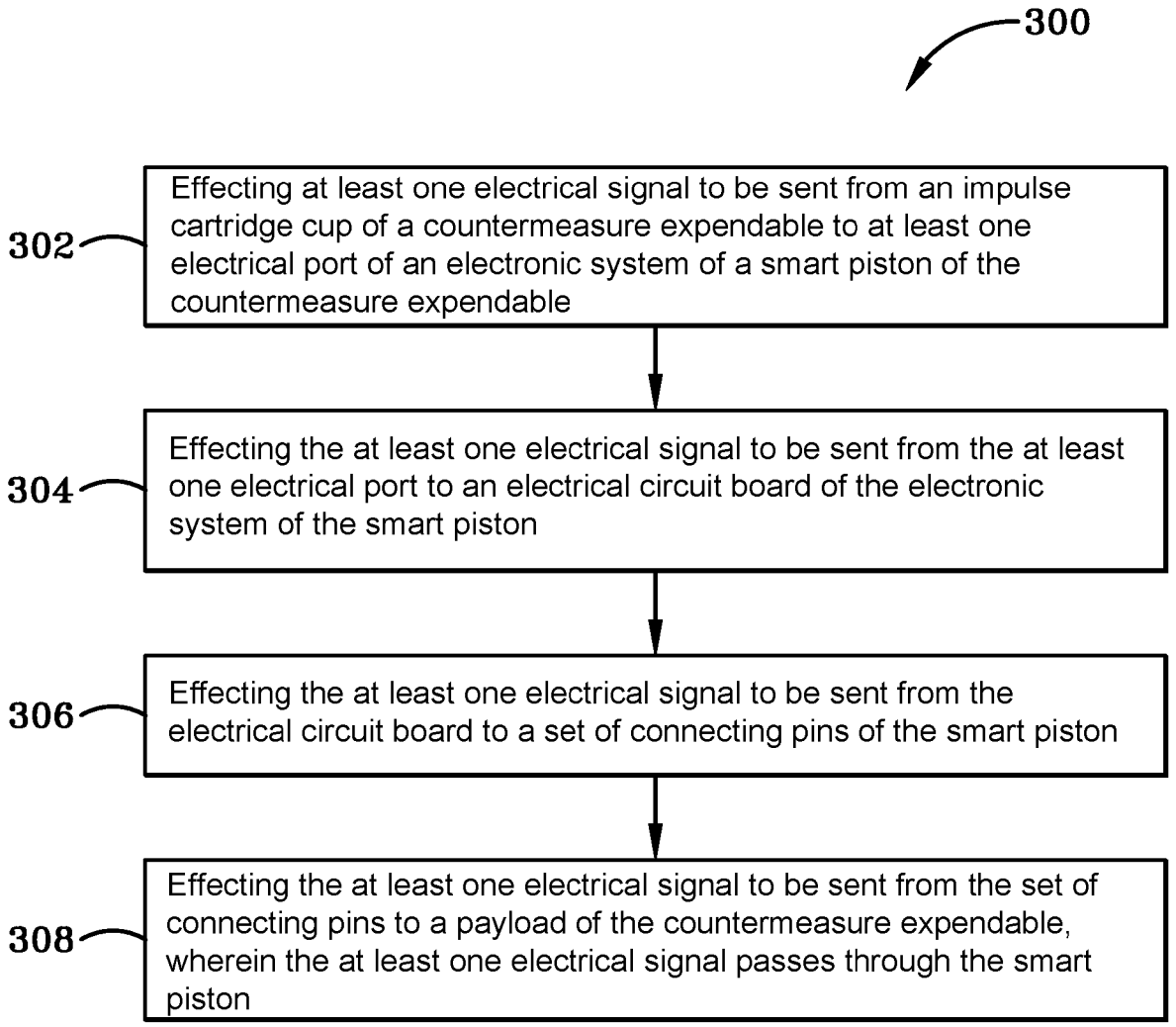
FIG. 17 is another exemplary method flowchart.

FIG. 17 illustrates a method 300. An initial step 302 of method 300 includes effecting at least one electrical signal to be sent from an impulse cartridge cup of a countermeasure expendable to at least one electrical port of an electronic system of a smart piston of the countermeasure expendable. Another step 304 of method 300 includes effecting the at least one electrical signal to be sent from the at least one electrical port to an electrical circuit board of the electronic system of the smart piston. Another step 306 of method 300 includes effecting the at least one electrical signal to be sent from the electrical circuit board to a set of connecting pins of the smart piston. Another step 308 of method 300 includes effecting the at least one electrical signal to be sent from the set of connecting pins to a payload of the countermeasure expendable, wherein the at least one electrical signal passes through the smart piston.

Optional steps and/or additional steps may be included in method 300. An optional step may further include that the step of effecting the at least one electrical signal to be sent from the impulse cartridge cup to the at least one electrical port further includes effecting the at least one electrical signal to be sent from the impulse cartridge cup to the at least one electrical port by a set of first electrical connections. Optional steps may further include that the steps of effecting the at least one electrical signal to be sent from the electrical circuit board to the set of connecting pins and effecting the at least one electrical signal to be sent from the set of connecting pins to the payload further comprising: effecting the at least one electrical signal to be sent from the electrical circuit board to a set of input terminals of the set of connecting pins, wherein the set of input terminals are positioned proximate to a rear end of the smart piston separate from the payload; and effecting the at least one electrical signal to be sent from a set of output terminals of the set of connecting pins to the payload by a set of second electrical connections, wherein the set of output terminals are positioned proximate to a front end of the smart piston adjacent with the payload. Optional steps may further include sealing a first chamber, via a gasket, defined between a front end of a canister of the countermeasure expendable and the gasket that houses the payload; and sealing a second chamber, via the gasket, defined between a rear end of the canister of the countermeasure expendable and the gasket that houses a squib of the countermeasure expendable. An optional step may further include biasing the payload, via a biaser of the smart piston, from a main body of the smart piston when the payload and the main body are external of the canister. Optional steps may further include removing a port plug of the countermeasure expendable from a canister of the countermeasure expendable; disconnecting the impulse cartridge cup from the at least one electrical port; connecting an external testing unit with the at least one electrical port of the electronic system; sending at least another electrical signal, via the external testing unit, to the at least one electrical port; and communicating with the payload of the countermeasure expendable by the external testing unit, wherein the at least another electrical signal passes through the smart piston.

The device, assembly, or system of the present disclosure may additionally include one or more sensor to sense or gather data pertaining to the surrounding environment or operation of the device, assembly, or system. Some exemplary sensors capable of being electronically coupled with the device, assembly, or system of the present disclosure (either directly connected to the device, assembly, or system of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A smart piston for a countermeasure expendable, the smart piston comprising:

a main body;

a gasket operably engaged with the main body; and an electronic system carried by the main body;

wherein the electronic system is in electrical communication with a payload of the countermeasure expendable and is positioned between the main body and the gasket;

wherein the electronic system comprises:

an electronic circuit board;

at least one electrical port operably engaged with the electronic circuit board and having a first amperage rating for sending at least one communication signal; and a set of connecting pins operably engaged with the electronic circuit board and the at least one electrical port;

wherein the electronic circuit board, the at least one electrical port, and the set of connecting pins are in electrical communication with one another; and wherein the electronic system further comprises:

at least another electrical port operably engaged with the electronic circuit board and the set of connecting pins and having a second amperage rating that is greater than the first amperage rating of the at least one electrical port for sending at least one power signal;

wherein the electronic circuit board, the at least one electrical port, the at least another electrical port, and the set of connecting pins are in electrical communication with one another.

2. The smart piston of claim 1, wherein the electronic system enables at least one electrical signal to pass through the main body to the payload of the countermeasure expendable where the electronic system and the payload are spaced apart from one another.

3. The smart piston of claim 1, wherein each connecting pin of the set of connecting pins passes entirely through the main body.

4. The smart piston of claim 1, wherein the at least one electrical port is adapted to electrically connect an impulse cartridge cup of the countermeasure expendable and an on-board processing unit of the countermeasure expendable with one another.

5. The smart piston of claim 1, wherein the at least one electrical port is adapted to electrically connect an external testing unit with an on-board processing unit of the countermeasure expendable for powering the on-board processing unit with the external testing unit and for communicating with the on-board processing unit with the external testing unit; and wherein the at least one electrical port is adapted to electrically connect an external testing unit with at least one powered electronic of the payload for powering the at least one high-power electronic with the external testing unit.

6. The smart piston of claim 1, wherein the main body comprises:

a front end;

a rear end opposite to the front end; and a set of through-holes defined in the main body extending between the front end and the rear end;

wherein the set of connecting pins is housed inside of the set of through-holes and extends from the front end of the main body to the rear end of the main body;

wherein the at least one electrical port operably engages at the rear end of the main body.

7. The smart piston of claim 6, wherein the main body further comprises:

a set of extensions extending outwardly from a base wall of the main body towards the front end of the main body;

wherein the set of extensions and the set of connecting pins operably engage with one another; and wherein one extension of the set of extensions defines a diameter that is greater than diameters of remaining extensions of the set of extensions for aligning the smart piston with the payload of the countermeasure expandable.

8. The smart piston of claim 6, wherein the gasket comprises:

a base wall of the gasket operably engaging with the main body; and an upright wall of the gasket extending outwardly from a peripheral edge of the base wall and being free from engaging with the main body;

wherein the upright wall is adapted to provide a seal between the smart piston and a canister of the countermeasure expendable.

9. The smart piston of claim 8, further comprising:

a protrusion of the main body extending outwardly from the rear end of the main body;

a hollow protrusion of the gasket extending outwardly from the base wall of the gasket; and at least one attachment aperture defined in the electronic circuit board for receiving the protrusion of the main body and the hollow protrusion of the gasket;

wherein the protrusion of the main body operably engages with the gasket inside of the hollow protrusion.

10. The smart piston of claim 8, further comprising:

a hollow projection of the main body extending outwardly from the rear end of the main body;

a tubular extension of the gasket extending outwardly from the base wall of the gasket; and a central opening defined in the electronic circuit board for receiving the hollow projection and the tubular extension;

wherein the hollow projection of the main body operably engages with the gasket inside of the tubular extension.

11. The smart piston of claim 10, further comprising:

a biaser operably engaged with the main body inside of the hollow projection;

wherein the biaser is adapted to bias the smart piston and a payload of the countermeasure expendable away from one another external of the canister of the countermeasure expendable.

12. The smart piston of claim 6, wherein the main body further comprises:

a set of extension arms;

a base wall positioned between the front end and the rear end; and a recess extending inwardly from the front end of the main body to the base wall of the main body;

wherein a portion of the payload of the countermeasure expendable is housed inside of the recess and operably engages with the set of extension arms and the base wall.

* * * * *